US008118630B2

(12) United States Patent
Konakawa et al.

(10) Patent No.: US 8,118,630 B2
(45) Date of Patent: Feb. 21, 2012

(54) OUTBOARD MOTOR

(75) Inventors: Tsugunori Konakawa, Shizuoka (JP); Yusuke Takahashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 221 days.

(21) Appl. No.: 12/542,059

(22) Filed: Aug. 17, 2009

(65) Prior Publication Data

US 2010/0056002 A1 Mar. 4, 2010

(30) Foreign Application Priority Data

Aug. 29, 2008 (JP) ..... 2008-221506

(51) Int. Cl.
*F01N 13/00* (2010.01)
*B63H 21/32* (2006.01)

(52) U.S. Cl. ..... 440/89 H; 440/89 G

(58) Field of Classification Search ..... 440/89 G, 440/89 H

See application file for complete search history.

(56) References Cited

U.S. PATENT DOCUMENTS 3,371,645 A * 3/1968 Ward ..... 440/89 R
4,070,983 A * 1/1978 Randall ..... 440/66
4,327,817 A * 5/1982 Scarton et al. ..... 181/296
4,378,859 A * 4/1983 Satomi et al. ..... 181/224
4,601,666 A * 7/1986 Wood, Jr. ..... 440/89 R
4,668,199 A * 5/1987 Freund et al. ..... 440/89 R
4,773,379 A * 9/1988 Hashimoto et al. ..... 123/568.28
4,795,383 A * 1/1989 Binversie et al. ..... 440/89 R
4,848,082 A * 7/1989 Takahashi et al. ..... 60/285
4,897,060 A * 1/1990 Okazaki ..... 440/89 R
4,952,182 A * 8/1990 Curtis et al. ..... 440/89 R
4,965,997 A * 10/1990 Suzuki et al. ..... 60/310
4,966,567 A * 10/1990 Breckenfeld et al. ..... 440/89 R
4,977,977 A * 12/1990 Von Widmann et al. ..... 181/235
4,986,780 A * 1/1991 Sougawa ..... 440/89 R
5,118,316 A * 6/1992 Kakizaki et al. ..... 440/89 R
5,348,500 A * 9/1994 Lassanske ..... 440/89 R
5,421,756 A * 6/1995 Hayasaka ..... 440/89 R
5,457,290 A * 10/1995 Sase et al. ..... 181/258
5,941,743 A * 8/1999 Kato ..... 440/1
6,196,888 B1 * 3/2001 Kawamura et al. ..... 440/89 R
6,220,907 B1 * 4/2001 Shimizu ..... 440/89 R
6,499,292 B2 * 12/2002 Kato ..... 60/284
6,632,110 B2 * 10/2003 Kato ..... 440/89 H (Continued)

OTHER PUBLICATIONS

Konakawa; "Exhaust Device for Outboard Motor Engine and Outboard Motor"; U.S. Appl. No. 12/542,054, filed Aug. 17, 2009.

*Primary Examiner* — Lars A Olson
*Assistant Examiner* — Andrew Polay
(74) *Attorney, Agent, or Firm* — Keating & Bennett, LLP

(57) ABSTRACT

An outboard motor includes an engine, a first exhaust passage, a partition, a communication portion, an exhaust gas concentration sensor, and a catalyst. The engine is arranged to support a crankshaft extending along an up-down direction. The first exhaust passage is connected to the engine and is arranged to exhaust exhaust gas of the engine into water. The partition is arranged to partition an inside of the first exhaust passage into an upstream side and a downstream side. The communication portion is arranged to make the upstream side communicate with the downstream side of the partition in the first exhaust passage. The exhaust gas concentration sensor is arranged on the upstream side of the partition in the first exhaust passage. The catalyst is arranged on an upstream side of the exhaust gas concentration sensor in the first exhaust passage.

13 Claims, 12 Drawing Sheets

U.S. PATENT DOCUMENTS 6,662,555 B1 * 12/2003 Ishii ..... 60/302
6,851,257 B1 * 2/2005 Yoshida et al. ..... 60/299
7,347,045 B2 * 3/2008 Bozmoski et al. ..... 60/312
7,476,136 B2 * 1/2009 Radue et al. ..... 440/89 R
7,513,811 B2 * 4/2009 Kameoka et al. ..... 440/89 G
7,536,855 B2 * 5/2009 Tsukahara ..... 60/324
7,867,048 B2 * 1/2011 Ochiai ..... 440/89 H
7,892,057 B1 * 2/2011 Belter ..... 440/89 G
7,930,883 B2 * 4/2011 Konakawa et al. ..... 60/323
7,980,231 B1 * 7/2011 Belter et al. ..... 123/568.11
2002/0034900 A1 * 3/2002 Kato ..... 440/89
2008/0022669 A1 1/2008 Konakawa et al.
2008/0022671 A1 * 1/2008 Konakawa et al. ..... 60/313
2010/0056001 A1 * 3/2010 Konakawa et al. ..... 440/89 H
2010/0240270 A1 * 9/2010 Ochiai ..... 440/89 H

* cited by examiner

OUTBOARD MOTOR

BACKGROUND OF THE INVENTION

1. Field of the Invention

The present invention relates to an outboard motor including a catalyst and an exhaust gas concentration sensor.

2. Description of Related Art

An outboard motor according to a prior art is described in U.S. Patent Application Publication No. 2008/0022669A1. This outboard motor includes an exhaust device. Also, the exhaust device includes a catalytic converter (hereinafter, referred to as "catalyst") which purifies exhaust gas and an oxygen sensor which detects a concentration of oxygen in exhaust gas. This exhaust device is arranged to purify exhaust gas of an engine by the catalyst and exhaust the exhaust gas into water from a boss of a propeller. This exhaust device is arranged to control an opening degree of an intake passage and a supply amount of fuel, etc., based on results of detection by the oxygen sensor so as to operate the engine with an air-fuel ratio which brings a high purification effect in the catalyst.

SUMMARY OF THE INVENTION

The inventor of preferred embodiments of the invention described and claimed in the present application conducted an extensive study and research regarding the design and development of an outboard motor, and in doing so, discovered and first recognized new unique challenges and problems created by the interplay and trade-off relationships of the combination of various problems with outboard motors. In view of the inventor's discovery of these new unique challenges and problems, the inventor further discovered and developed the preferred embodiments of the present invention, described in greater detail below, to provide unique solutions to previously unrecognized and unsolved problems.

More specifically, in an exhaust passage of the exhaust device, water or water vapor may be produced. Water is primarily produced by liquefaction of water vapor inside the exhaust passage. Also, water vapor is produced when water entering the exhaust passage from an outlet of the exhaust passage comes into contact with exhaust gas or a wall of the exhaust passage heated by high-temperature exhaust gas. An amount of produced water vapor increases when a pressure inside the exhaust passage excessively decreases.

Excessive decreasing of the pressure inside the exhaust passage is caused, for example, when a throttle valve of the engine is rapidly fully closed from a fully opened state and the engine misfires. When the engine misfires, the pressure of exhaust gas to be exhausted from the engine into the exhaust passage decreases. Also, when the engine misfires during running of a hull including the outboard motor, a suctioning force toward the engine is applied to the exhaust gas inside the exhaust passage, such that the pressure inside the exhaust passage further decreases.

Liquefaction of water vapor occurs when the pressure inside the exhaust passage becomes relatively high. For example, when the pressure inside the exhaust passage excessively decreases due to misfiring of the engine, a large amount of water vapor is produced. Immediately after this, when the operation of the engine is restarted and the pressure of the exhaust gas increase, the water vapor is liquefied in the exhaust passage.

The catalyst and the oxygen sensor may include ceramics. In this case, a portion of the oxygen sensor to be exposed to exhaust gas is made of ceramics. The resistance of ceramics to water is deteriorated by a high temperature. In detail, when water is attached to ceramics at an excessively high temperature, the ceramics may be damaged. Also, the catalyst and the oxygen sensor may have a high temperature during running of an outboard motor. Therefore, water inside the exhaust passage produced by liquefaction of water vapor may be attached to the catalyst and the oxygen sensor at a high temperature. However, when water is attached to the catalyst and the oxygen sensor at a high temperature, these components may be damaged.

Thus, the inventor discovered and carefully studied the many varying problems described above, and recognized certain unique and unsolved interrelationships and trade-offs, and the effects of various unique solutions on such diverse and numerous problems. After diligent research and work on such unique problems and novel potential solutions, the preferred embodiments of the present invention were discovered and developed.

A preferred embodiment of the present invention provides an outboard motor including an engine, a first exhaust passage, a partition, a communication portion, an exhaust gas concentration sensor, and a catalyst. The engine is arranged to support a crankshaft extending along an up-down direction. The first exhaust passage is connected to the engine and is arranged to expel exhaust gas of the engine into water. The partition is arranged to partition an inside of the first exhaust passage into an upstream side and a downstream side. The communication portion is arranged to cause the upstream side to communicate with the downstream side of the partition in the first exhaust passage. The exhaust gas concentration sensor is arranged on the upstream side of the partition in the first exhaust passage. The catalyst is arranged on an upstream side of the exhaust gas concentration sensor in the first exhaust passage. The exhaust gas concentration sensor detects a concentration of a component of exhaust gas. The exhaust gas concentration sensor detects a concentration of, for example, oxygen ($O_2$), carbon monoxide (CO), carbon dioxide ($CO_2$), total hydrocarbons (THC), or nitrogen oxide ($NO_x$), for example. The exhaust gas concentration sensor may be primarily made of ceramics, for example.

With this configuration, the inside of the first exhaust passage is partitioned by the partition into an upstream side and a downstream side, such that the partition functions as a dam. Therefore, even when water and water vapor are produced in the first exhaust pipe, the amount of water and water vapor to flow into the upstream side of the partition is small. Therefore, it is difficult for water to attach to the exhaust gas concentration sensor and catalyst provided on the upstream side of the partition in the first exhaust passage. As a result, the exhaust gas concentration sensor and the catalyst are prevented from being damaged by attachment of water.

In a preferred embodiment of the present invention, to a portion on the downstream side of the partition in the first exhaust passage, an inlet end of a second exhaust passage is connected. An outlet end of the second exhaust passage may communicate with the atmosphere. In this case, exhaust gas in the first exhaust passage is exhausted into an atmosphere through the second exhaust passage.

In a preferred embodiment of the present invention, the first exhaust passage includes an exhaust chamber, the inside of which is partitioned by the partition into an upstream side exhaust gas chamber and a downstream exhaust gas chamber. The exhaust gas concentration sensor may be arranged in an upstream side exhaust gas chamber. Also, an inlet end of the second exhaust passage may be connected to the downstream exhaust gas chamber. Also, the first exhaust passage may include an exhaust pipe arranged on an upstream side of the exhaust chamber. In this case, the catalyst may be arranged in the exhaust pipe.

In a preferred embodiment of the present invention, the communication portion includes a communication hole provided in the partition and arranged to communicate between both the upstream side and the downstream side of the partition, and an on-off valve provided in the communication hole. In this case, the outboard motor may include a drive mechanism which is arranged to drive the on-off valve, a pressure sensor which is arranged to detect a pressure inside the first exhaust passage, and a control device which is arranged to control the drive mechanism. Also, a detection value of the pressure sensor may be input into the control device. The control device may control the drive mechanism so as to close the on-off valve when the pressure inside the first exhaust passage is not more than a predetermined value.

In a preferred embodiment of the present invention, the first exhaust passage includes a downstream side end portion arranged to allow entrance of water from an outside of the outboard motor during idling of the engine. A portion which is higher than a water surface at a time of the idling and near the water surface at a downstream side end portion of the first exhaust passage and the second exhaust passage may be made to communicate with each other by a communication path. Further, the inlet end of the second exhaust passage may be connected to a highest portion in the first exhaust passage. When the first exhaust passage includes an exhaust chamber, the inside of which is partitioned by a partition into an upstream side exhaust gas chamber and a downstream side exhaust gas chamber, the highest portion in the first exhaust passage may be defined by the exhaust chamber.

In a preferred embodiment of the present invention, the second exhaust passage includes a sound absorbing chamber which is arranged at a downstream side end portion of the second exhaust passage and is removable from the outboard motor. An inside of the sound absorbing chamber may communicate with the first exhaust passage via the communication path.

In a preferred embodiment of the present invention, the second exhaust passage includes a sound absorbing chamber arranged at the downstream side end portion of the second exhaust passage. The sound absorbing chamber may include a plurality of expansion chambers partitioned by partitioning members, and expansion chamber communication holes which are provided in the partition members and communicate the plurality of expansion chambers with each other. Also, the inside of the sound absorbing chamber may communicate with the first exhaust passage via the communication path. Opening areas of the expansion chamber communication holes may be smaller than a smallest passage cross-section area of an upstream side of the sound absorbing chamber.

Also, in a preferred embodiment of the present invention, the inlet end of the second exhaust passage is connected to a highest portion in the first exhaust passage.

Also, in a preferred embodiment of the present invention, the inlet end of the second exhaust passage is connected to the highest portion in the first exhaust passage, and the highest portion in the first exhaust passage is defined by the exhaust chamber.

Other elements, features, steps, characteristics, and advantages of the present invention will become more apparent from the following detailed description of the preferred embodiments with reference to the attached drawings.

DETAILED DESCRIPTION OF THE PREFERRED EMBODIMENTS

Figure 1:
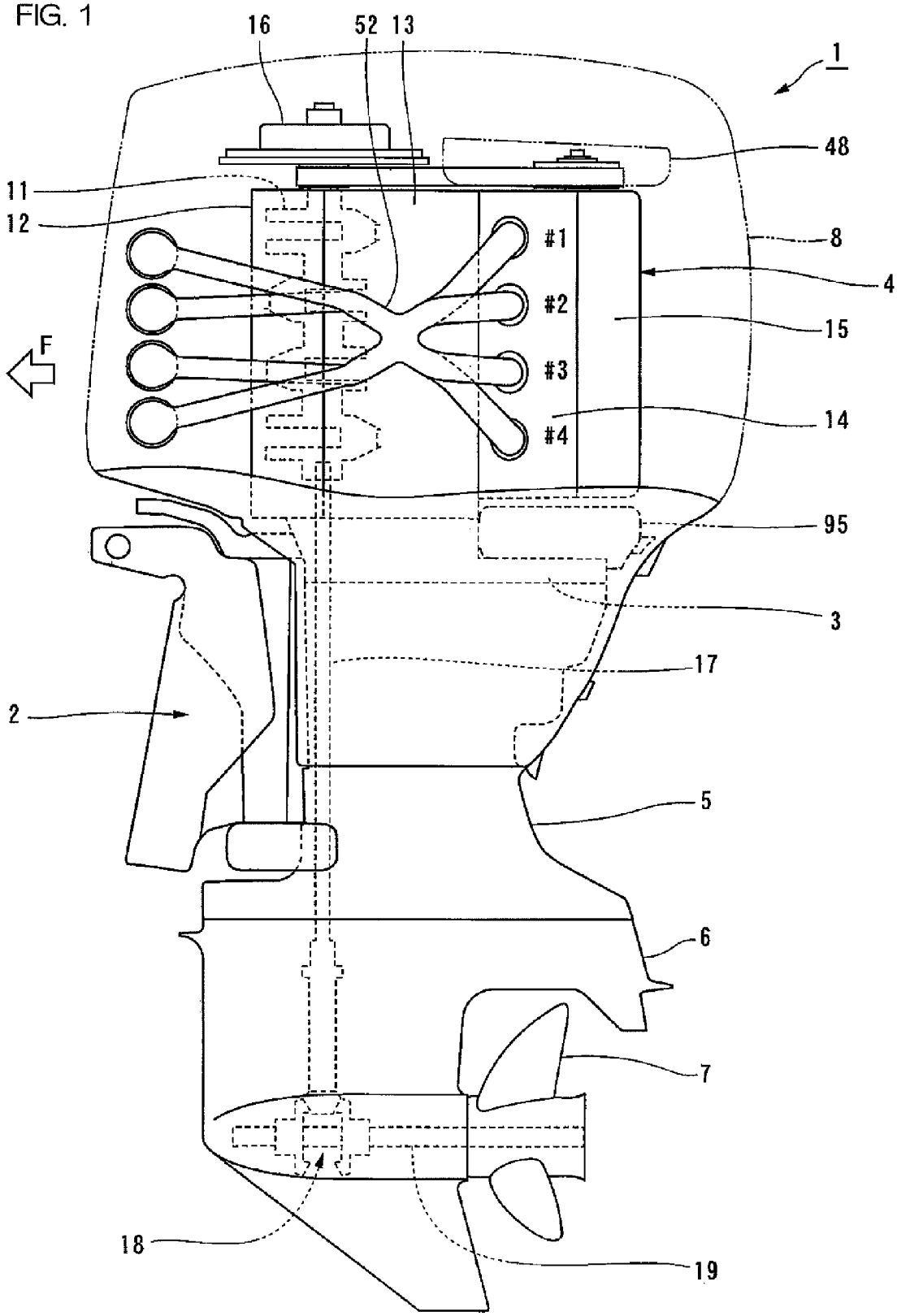
FIG. 1 is a side view of an outboard motor of a preferred embodiment of the present invention, drawn in a state in which a portion of an engine cover is omitted.

Hereinafter, an outboard motor 1 of a preferred embodiment of the present invention will be described in detail with reference to FIG. 1 to FIG. 12.

The outboard motor 1 of this preferred embodiment is to be attached to a transom board of a hull not shown so as to be steered and tilted via a bracket 2. Therefore, the outboard motor 1 can be in various postures with respect to the hull in an actual use state; however, in this specification, for the sake of convenience, based on a predetermined reference posture of the outboard motor 1, up-down, left-right, and front-rear directions are defined. The reference posture is a posture of the outboard motor 1 at a steering angle of zero and a tilt angle of zero with respect to the hull in the horizontal posture. In this condition, when a propulsive force in the forward drive direction is generated from the outboard motor 1, the hull moves straight ahead. In other words, in this specification, as expressions of directions of the outboard motor 1 and the respective members, the heading direction of a hull when it moves ahead, that is, when it moves straight ahead is simply referred to as the front of the outboard motor 1, and the side 180 degrees opposite to the front is referred to as the rear side. In addition, the left side of the hull with respect to the heading direction of the hull when the hull moves ahead is referred to as the outboard motor left side or the left side simply, the right side of the hull with respect to the heading direction when the hull moves ahead is referred to as the outboard motor right side or the right side simply. Further, the left-right direction of the outboard motor 1 when the hull moves ahead is referred to as the left-right direction of the outboard motor 1.

Also, in the drawings, an arrow F indicating the forward side of the outboard motor 1 is shown as is appropriate.

FIG. 1 is a side view of the outboard motor 1 of a preferred embodiment of the present invention. The outboard motor 1 includes an engine support member 3, an engine 4, an upper casing 5, a lower casing 6, a propeller 7, and an engine cover 8. The engine support member 3 is a plate-shaped member joined to the upper end of a bracket 2. On the engine support member 3, the engine 4 is mounted. In addition, to the lower portion of the engine support member 3, the upper casing 5 is attached. To the lower end of the upper casing 5, the lower casing 6 is attached. Onto the lower casing 6, the propeller 7 is supported rotatably. The engine cover 8 covers the engine 4. In FIG. 1, etc., the external shape of the engine cover 8 is indicated by a phantom line, and the internal structure is shown by a see-through engine cover 8.

The engine 4 preferably is a four-cycle four-cylinder engine in this preferred embodiment. The engine 4 is mounted on the engine support member 3 in a posture in which the axis line of the crankshaft 11 extends along the up-down direction. Four cylinders of the engine 4 are positioned behind the crankshaft 11 (opposite side of the hull with respect to the crankshaft 11), and are aligned in series along the up-down direction. In the present preferred embodiment, among the four cylinders of the engine 4, the highest cylinder is referred to as a first cylinder #1, and cylinders below the first cylinder #1 are referred to as, in order from the top, a second cylinder #2, a third cylinder #3, and a fourth cylinder #4. In the engine 4, the first cylinder #1, the third cylinder #3, the fourth cylinder #4, and the second cylinder #2 are ignited in this order, for example.

The crankshaft 11 is arranged so as to penetrate through the engine 4 in the up-down direction. At an upper end portion of the crankshaft 11, a flywheel magneto 16 is provided. To the lower end of the crankshaft 11, a drive shaft 17 is coupled. The drive shaft 17 extends along the up-down direction from the lower end of the engine 4 to the inside of the lower casing 6. The drive shaft 17 is supported rotatably onto the engine support member 3, the upper casing 5 and the lower casing 6 via bearings (not shown). The lower end of the drive shaft 17 is coupled to a propeller shaft 19 via a forward-reverse switching mechanism 18. The propeller 7 rotates integrally with the propeller shaft 19.

Figure 2:
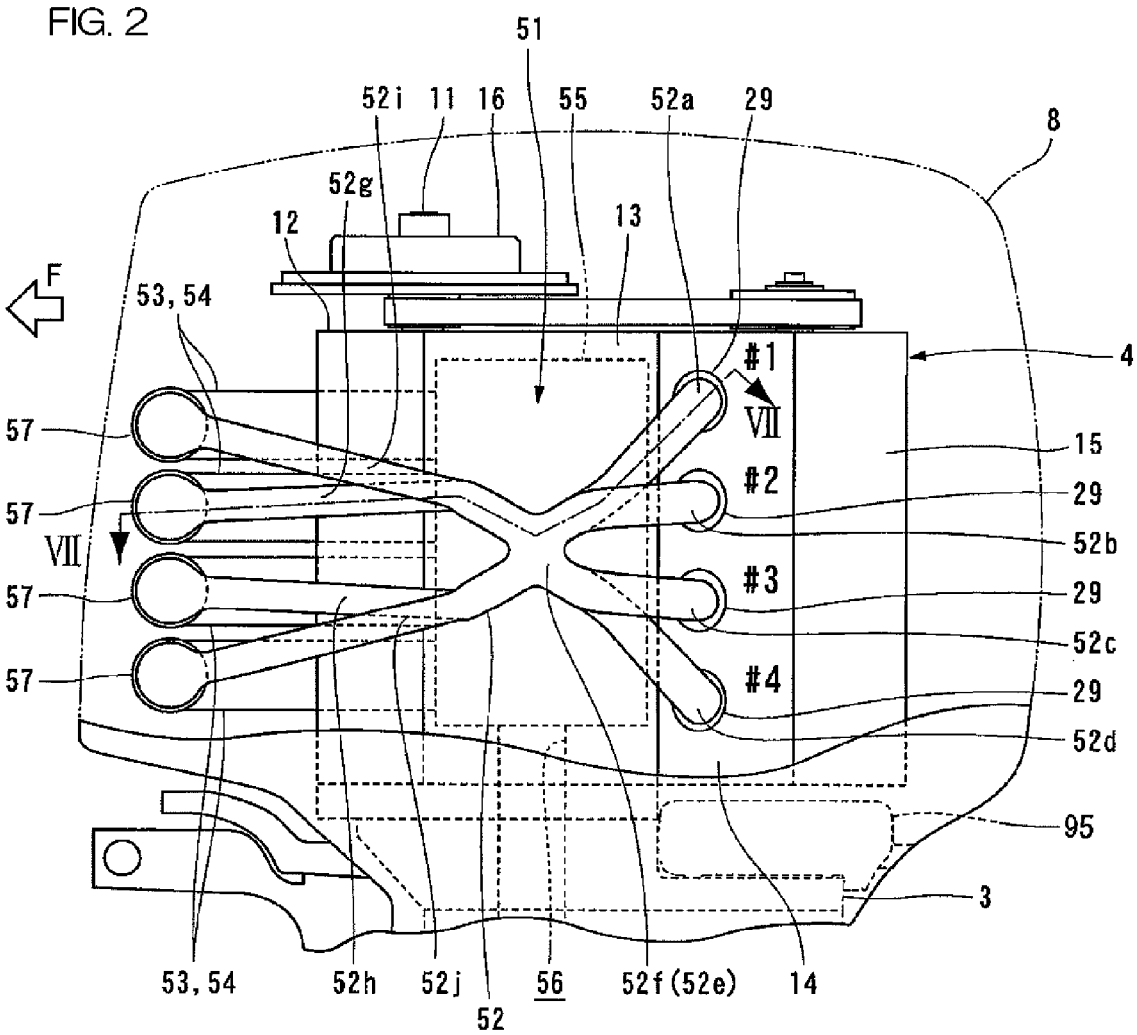
FIG. 2 is an enlarged side view of an engine section of the outboard motor.
Figure 3:
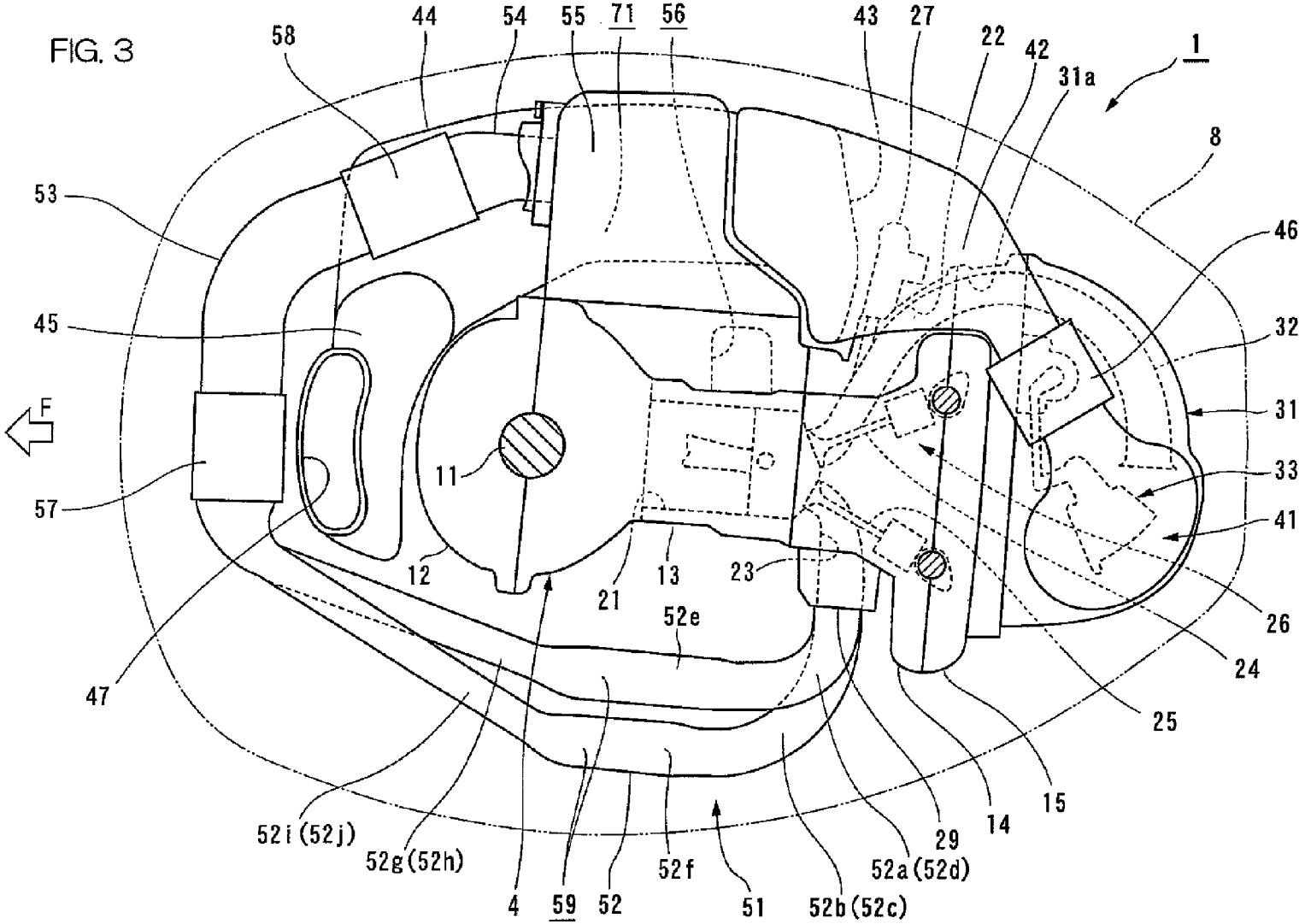
FIG. 3 is an enlarged plan view of the engine section of the outboard motor.

FIG. 2 is an enlarged side view of the engine portion, and FIG. 3 is an enlarged plan view of the engine portion. The engine 4 includes a crank case 12, a cylinder body 13, a cylinder head 14, and a head cover 15. The crank case 12 and the cylinder body 13 rotatably support the crankshaft 11. The cylinder head 14 is attached to the cylinder body 13. The head cover 15 is attached to the cylinder head 14. The crank case 12, the cylinder body 13, the cylinder head 14, and the head cover 15 are arranged in the front-rear direction of the outboard motor 1 in this order from the forward side of the outboard motor 1. In addition, the crank case 12, the cylinder body 13, the cylinder head 14, and the head cover 15 are mounted on the engine support member 3, respectively.

In the cylinder body 13, cylinders 21 (see FIG. 3) constituting first cylinder #1 to fourth cylinder #4 are provided and lined up in the up-down direction. As shown in FIG. 3, in the cylinder head 14, an intake port 22 and an exhaust port 23 are preferably provided for each of the cylinders. Further, the cylinder head 14 is provided with intake valves 24 and exhaust valves 25 arranged to open and close these ports 22 and 23, respectively. The cylinder head 14 is further provided with a valve operating device 26 arranged to drive the intake valve 24 and exhaust valve 25 and an injector 27 for each cylinder arranged to inject fuel into the intake port 22.

The intake ports 22 are provided at the side portion on the outboard motor right side of the cylinder head 14, that is, at the side portion on the opposite side of the exhaust ports 23 with respect to the left-right direction of the outboard motor 1 as shown in FIG. 3. The intake ports 22 extend toward the outboard motor rear side, that is, toward the head cover 15 side, so as to separate from the crank case 12. The respective inlet end of the intake ports 22 is connected to corresponding intake pipes 32 inside an intake surge tank 31 arranged behind the head cover 15. The intake surge tank 31 is arranged at the rear end of the engine 4. The rear end of the engine 4 is an end on the opposite side of the crank case 12 in a plan view.

The exhaust ports 23 open on the outer portion (side portion on the outboard motor left side) in the left-right direction of the outboard motor 1 of the cylinder head 14, and are connected to an exhaust device 51 as shown in FIG. 3. The openings of the exhaust ports 23 define exhaust gas outlets 29.

As shown in FIG. 3, the exhaust device 51 includes a first exhaust pipe 52, a second exhaust pipe 53, a third exhaust pipe 54, an exhaust chamber 55, and a main exhaust passage 56. An upstream end of the first exhaust pipe 52 is connected to the exhaust gas outlets 29. The second exhaust pipe 53 is connected to a downstream end of the first exhaust pipe 52. The third exhaust pipe 54 is connected to a downstream end of the second exhaust pipe 53. The exhaust chamber 55 is connected to a downstream end of the third exhaust pipe 54. The main exhaust passage 56 is arranged so as to extend downward from a downstream end portion of the exhaust chamber 55.

In the present preferred embodiment, the first exhaust passage 59 is defined by spaces inside the first to third exhaust pipes 52 to 54, a space inside the exhaust chamber 55, and the main exhaust passage 56. Also, in the present preferred embodiment, an exhaust pipe is defined by the first to third exhaust pipes 52 to 54. FIG. 2 and FIG. 3 are drawn such that only an external form of the insides of the first to third exhaust pipes 52 to 54 (corresponding to a portion of the first exhaust passage 59) is shown.

Figure 4:
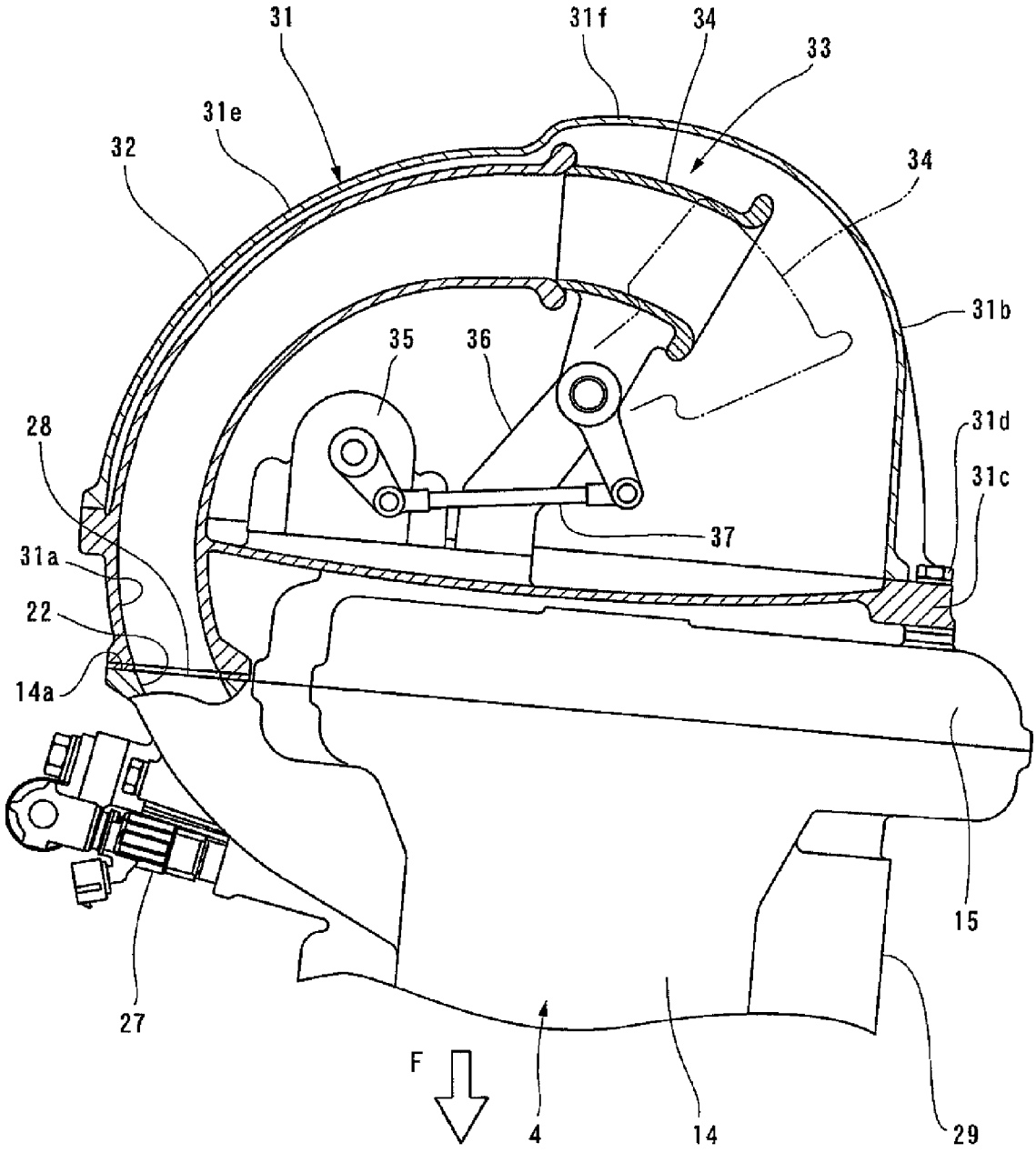
FIG. 4 is a sectional view of an intake surge tank section.

FIG. 4 is a sectional view for describing a configuration relating to the intake surge tank 31. The inlet ends of the intake ports 22 open on the end on the outboard motor right side of the rear surface 14*a* of the cylinder head 14 (a surface to which the head cover 15 is connected). The openings of the inlet ends of the intake ports 22 define intake inlets 28 of the engine 4. The intake inlets 28 are provided on the opposite sides of the exhaust gas outlets 29 in the left-right direction of the outboard motor 1. The intake inlets 28 are connected to intake holes 31*a* of the intake surge tank 31 attached to the rear surface 14*a* of the cylinder head 14. The intake holes 31*a* are connected to the respective intake pipes 32 inside the intake surge tank 31.

The intake surge tank 31 has a box-shaped intake surge tank main body 31*b* opening toward the front of the outboard motor 1 (head cover 15 side), and an attaching member 31*c* which closes the opening portion of the intake surge tank main body 31*b*. The intake surge tank 31 is attached to the head cover 15 with attaching bolts 31*d*.

The intake pipes 32 are arranged so as to extend while curving in an arc shape in a plan view. In detail, the intake pipes 32 curve so as to project to the rear side (upper side in FIG. 4) of the outboard motor 1, that is, in the opposite direction of the crank case 12 with respect to the cylinder head 14 from the intake inlets 28. Also, the intake pipes 32 curve so as to project to the left side (right side in FIG. 4) of the outboard motor 1, that is, come closer to the exhaust ports 23 (see FIG. 3) in the left-right direction of the outboard motor 1. The intake pipes 32 are extended along the side wall 31*e* on the outboard motor right side and the rear wall 31*f* of the suction surge tank main body 31*b* inside the intake surge tank 31. The intake pipes 32 open within an end portion on the outboard motor rear side inside the intake surge tank 31.

The intake hole 31*a* and the intake pipe 32 are provided for each cylinder, and define an intake passage for each cylinder in cooperation with the intake port 22 of each cylinder. The inlet ends of the intake pipes 32 define intake ports of the engine 4. As described below, intake passages extend to the head cover 15 side, such that the length of the intake passages can be secured while the first exhaust passage 59 is formed to be long.

At the inlet ends of the intake pipes 32, a variable intake pipe mechanism 33 is provided. The variable intake pipe mechanism 33 includes an auxiliary intake pipe 34 removably connected to the intake pipes 32, and a pair of servo motors 35 which drives the auxiliary intake pipe 34. The auxiliary intake pipe 34 is provided for each intake pipe 32 of each cylinder. These auxiliary intake pipes 34 are pivotally supported on a support bracket 36 such that they can move between the connecting position shown by the solid line in FIG. 4 and the separated position shown by a phantom line in FIG. 4.

Figure 6:
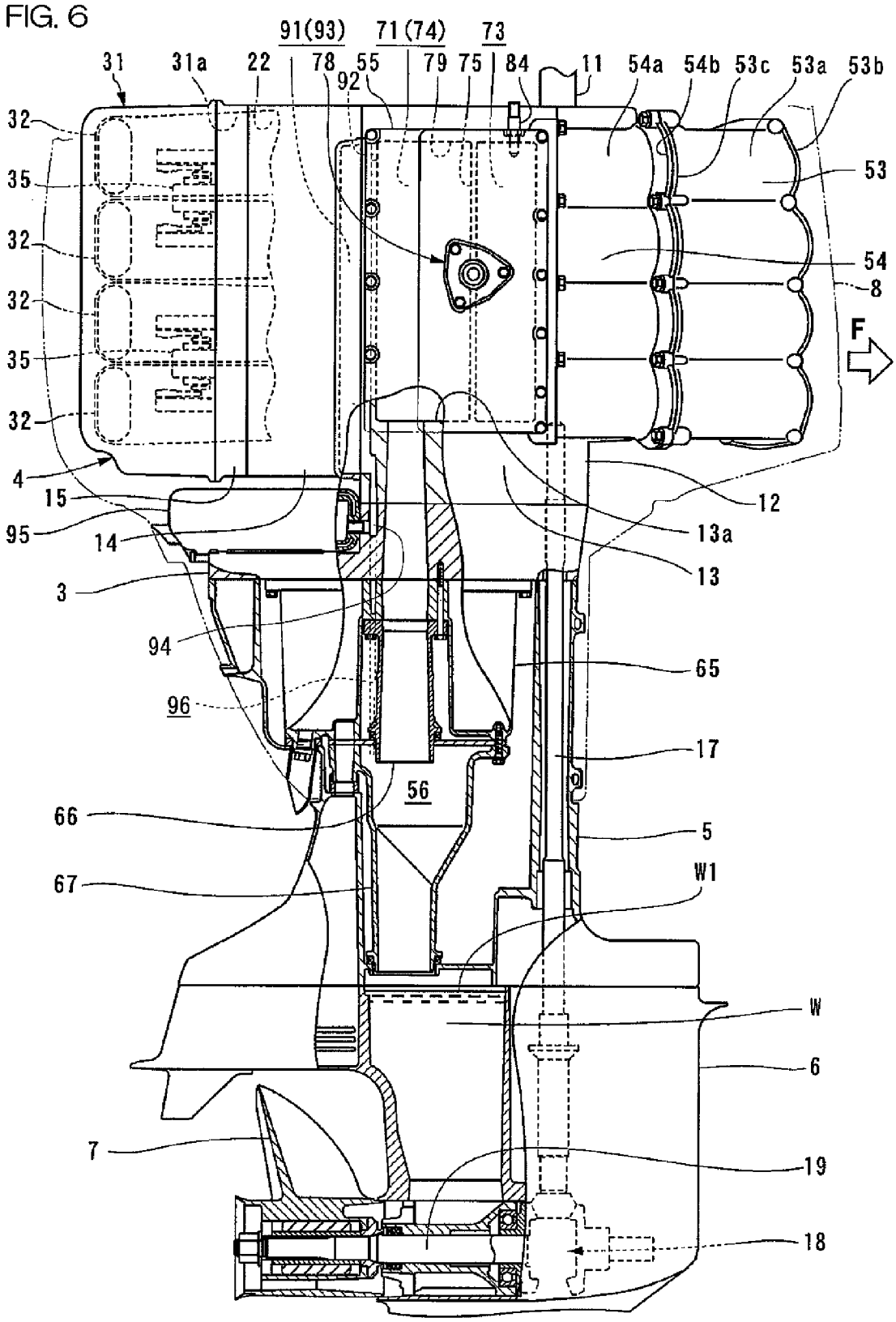
FIG. 6 is a sectional view for describing a configuration of an exhaust system.

These auxiliary intake pipes 34 are joined to the servo motors 35 via links 37. These auxiliary intake pipes 34 are driven to turn by the servo motors 35 to be in the connecting position or the separated position. By disposing the auxiliary intake pipes 34 at the connecting position, the intake pipe length becomes relatively long. Also, by moving the auxiliary intake pipes 34 to the separated position, the intake pipe length becomes relatively short. The servo motors 35 are provided at the upper portion and the lower portion of the head cover 15, respectively, as shown in FIG. 6. The servo motor 35 positioned on the upper side drives the first cylinder auxiliary intake pipe 34 and the second cylinder auxiliary intake pipe 34, and the servo motor 35 positioned on the lower side drives the third cylinder auxiliary intake pipe 34 and the fourth cylinder auxiliary intake pipe 34.

As shown in FIG. 3, an intake duct 41 is connected to the upper end of the intake surge tank 31. The intake duct 41 is arranged to lead the air inside the engine cover 8 to the intake port of the engine 4 (the inlet end of the intake pipes 32 opening inside the intake surge tank 31). The intake duct 41 preferably has a U shape as viewed from the outboard motor right side as shown in the side view of FIG. 5. That is, the intake duct 41 includes a downstream side horizontal portion 42, a downstream side vertical portion 43, an upstream side horizontal portion 44, and an upstream side vertical portion 45.

Figure 5:
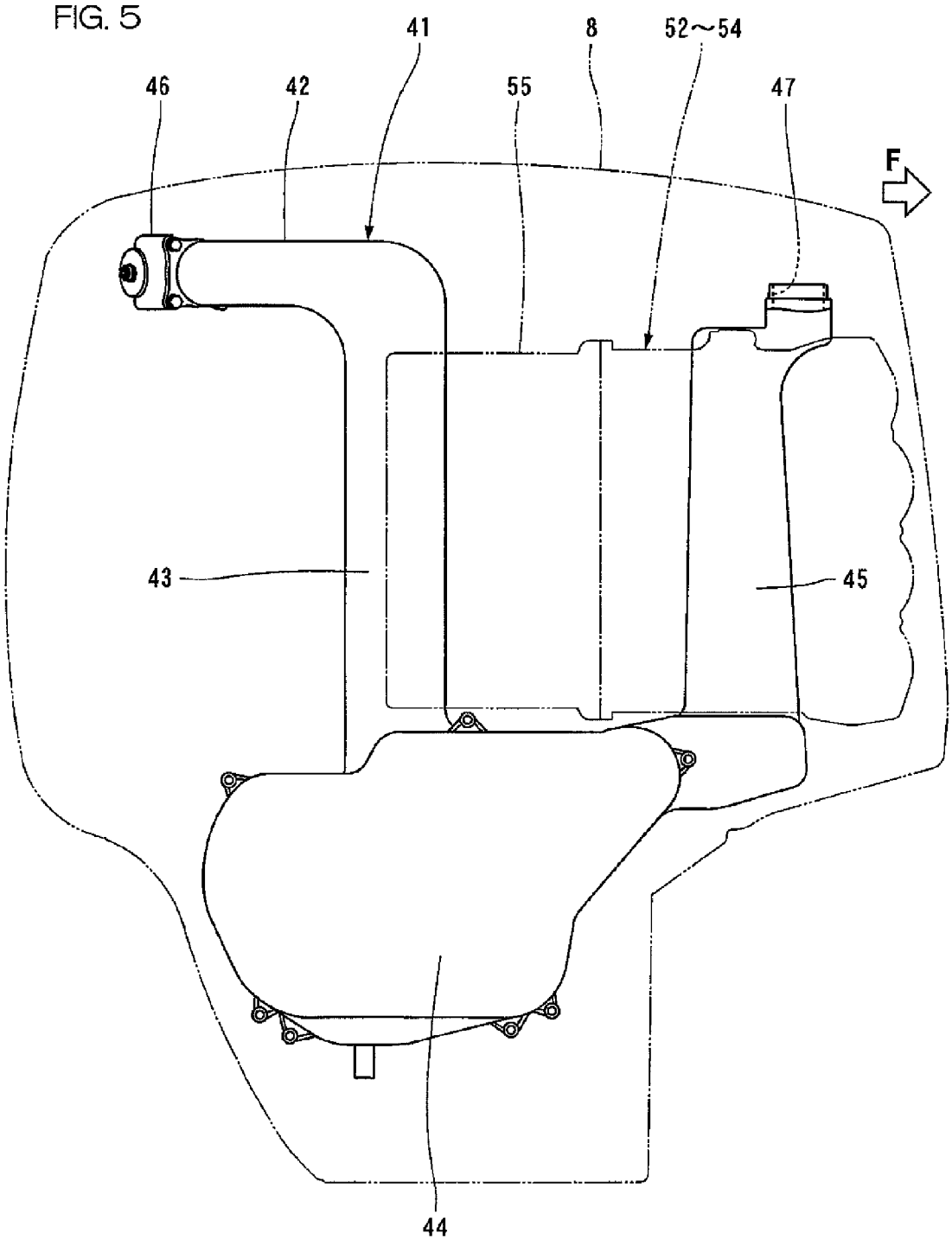
FIG. 5 is a side view of an intake duct.

As shown in FIG. 3, the downstream side horizontal portion 42 extends in the front-rear direction on the upper rear right side of the engine 4, and the downstream side end portion of the downstream side horizontal portion 42 is connected to an upper end portion of the intake surge tank 31. In the downstream side horizontal portion 42, a throttle valve 46 is provided. Also, as shown in FIG. 3, the downstream side vertical portion 43 is positioned on the lateral right side of the engine 4. The downstream side vertical portion 43 extends downward to the vicinity of the lower end portion of the engine 4 from the front end portion of the downstream side horizontal portion 42. As shown in FIG. 5, the upstream side horizontal portion 44 extends forward from the lower end portion of the downstream side vertical portion 43. In addition, the upstream side vertical portion 45 extends upward from the front end portion of the upstream side horizontal portion 44 to the height of the vicinity of the upper end portion of the engine 4.

As shown in FIG. 5, at the upper end portion of the upstream side vertical portion 45, an air suction port 47 is provided. The air suction port 47 has a tubular shape extending in the up-down direction. An opening shape of the air suction port 47 is has an elongated oval shape in the left-right direction of the outboard motor 1 as shown in FIG. 3.

In addition, the air suction port 47 is arranged at an upper end portion on the outboard motor front side inside the engine cover 8 surrounding the engine 4. As shown in FIG. 1, the space inside the engine cover 8 communicates with the atmosphere via an air inlet 48 provided on the rear portion on the outboard motor left side of the engine cover 8.

FIG. 6 is a sectional view for describing a configuration of an exhaust system. The main exhaust passage 56 opens in water at the shaft center of the propeller 7. The main exhaust passage 56 preferably includes a plurality of members. Specifically, the plurality of members of the main exhaust passage 60 include a cylinder body 13 of the engine 2, an engine support member 3, an oil pan 65 attached to the lower end of the engine support member 3, and a pipe 66 attached to the oil pan 65. Further, the plurality of members of the main exhaust passage 60 include a muffler 67 which is attached to the lower end of the oil pan 65 and extends downward, the upper casing 5 which houses the muffler 67, and the lower casing 6.

Figure 7:
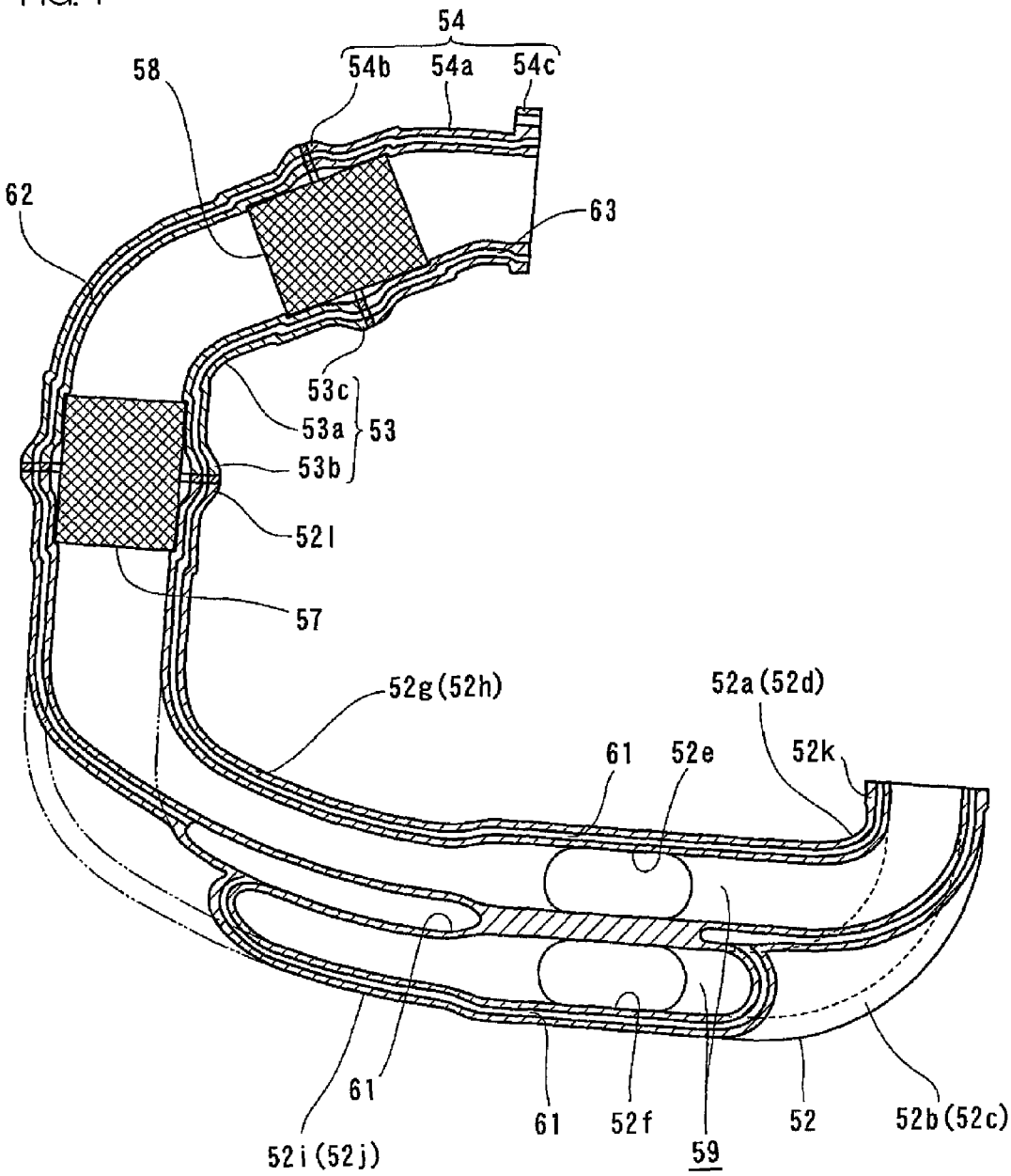
FIG. 7 is a sectional view of an exhaust pipe, along VII-VII line of FIG. 2.

FIG. 7 is a sectional view of an exhaust pipe along VII-VII of FIG. 2. The first to third exhaust pipes 52 to 54 are molded preferably by casting into pipe shapes, respectively, for example. The first exhaust pipe 52 has a double pipe structure such that the first exhaust passage 59 is covered by a coolant passage 61. Also, the second and third exhaust pipes 53 and 54 also have the same double pipe structure as the first exhaust pipe 52, formed in to a pipe shape preferably by casting, for example. The coolant passage 61 formed inside the first exhaust pipe 52 communicates with a coolant passage (not shown) of the cylinder head 3. Also, the coolant passage 61 is connected to the coolant passage 64 (see FIG. 8) inside the exhaust chamber 55 via the coolant passages 62 and 63 inside the second exhaust pipe 53 and the third exhaust pipe 54.

Inside the connecting portion between the first exhaust pipe 52 and the second exhaust pipe 53, a first catalyst 57 is provided. In addition, inside the connecting portion between the second exhaust pipe 53 and the third exhaust pipe 54, a second catalyst 58 is provided. The first and second catalysts 57 and 58 preferably are made of a so-called ternary catalyst. The ternary catalyst can detoxify hydrocarbon, nitrogen oxide, and carbon monoxide at the time of combustion near a theoretical air-fuel ratio at the same time. The first catalyst 57 is arranged on the opposite side of the crank case 12 across the air suction port 47 as shown in FIG. 3. In other words, the first catalyst 57 is arranged on the further front of the outboard motor 1 than the air suction port 47 in a plan view.

As shown in FIG. 2, the first exhaust pipe 52 collects exhaust gases exhausted from the four exhaust gas outlets 29 of the cylinder head 14 at two points, and further distributes the exhaust gases to four points (four second exhaust pipes 53). In detail, the first exhaust pipe 52 includes four upstream portions 52*a* to 52*d*, two collecting portions (first and second collecting portions 52*e* and 52*f*), and four downstream portion (first to fourth downstream portions 52*g* to 52*j*).

Inlet ends of the four upstream portions 52*a* to 52*d* are respectively connected to the exhaust gas outlets 29 of the four cylinders. An outlet end of the first cylinder upstream portion 52*a* and an outlet end of the fourth cylinder upstream portion 52*d* are connected to the first collecting portion 52*e*. Also, an outlet end of the second cylinder upstream portion 52*b* and an outlet end of the third cylinder upstream portion 52*c* are connected to the second collecting portion 52*f*. In other words, to the first collecting portion 52*e*, the first and fourth cylinder upstream portions 52*a* and 52*d* which are respectively connected to the first cylinder #1 and the fourth cylinder #4 to be ignited in ignition periods 360 degrees different from each other are connected. In addition, to the second collecting portion 52*f*, the second and third cylinder upstream portions 52*b* and 52*c* respectively connected to the second cylinder #2 and the third cylinder #3 to be ignited in ignition periods 360 degrees different from each other are connected. The first and second downstream portions 52*g* and 52*h* are connected to the first collecting portion 52*e* so as to branch from the first collecting portion 52*e*. Also, the third and fourth downstream portions 52*i* and 52*j* are connected to the second collecting portion 52*f* so as to branch from the second collecting portion 52*f*.

As shown in FIG. 3, the first and fourth cylinder upstream portions 52*a* and 52*d* are arranged closer to the engine 4 in the left-right direction of the outboard motor 1 than the second and third cylinder upstream portions 52*b* and 52*c*. Therefore, the first collecting portion 52*e* is provided at a position closer to the engine 4 than the second collecting portion 52*f*. As shown in FIG. 2, the first collecting portion 52*e* and the second collecting portion 52*f* are arranged at substantially the same height as that of the central portion in the up-down direction of the cylinder body 13. Accordingly, the pipe length of the first cylinder upstream portion 52*a* and the pipe length of the fourth cylinder upstream portion 52*d* can be made equal to each other. Also, the pipe length of the second cylinder upstream portion 52*b* and the pipe length of the third cylinder upstream portion 52*c* can be made equal to each other.

The first and fourth cylinder upstream portions 52*a* and 52*d* are preferably longer than the second and third cylinder upstream portions 52*b* and 52*c* in a side view shown in FIG. 2. On the other hand, the second and third cylinder upstream portions 52*b* and 52*c* are preferably constructed such that the radius of curvature of the bent portions for connection to the cylinder head 14 become higher than the radius of curvature of the first and fourth cylinder upstream portions 52*a* and 56*d* as shown in FIG. 3. With this configuration, pipe lengths of the four upstream portions 52*a* to 52*d* are matched with each other.

At the inlet ends of the first to fourth cylinder upstream portions 52*a* to 52*d*, as shown in FIG. 7, an upstream side attaching flange 52*k* arranged to attach the first exhaust pipe 52 to the cylinder head 14 is formed integrally. The inlet ends of the first to fourth cylinder upstream portions 52*a* to 52*d* are connected to each other by the upstream side attaching flange 52*k*.

On the other hand, the first and second downstream portions 52*g* and 52*h* extend upward and downward as they go to the downstream side (forward of the outboard motor 1, and toward the crank case 12 side in a side view shown in FIG. 2) from the first collecting portion 52*e* as shown in FIG. 2. These first and second downstream portions 52*g* and 52*h* are bent forward of the outboard motor 1 such that their inclination angles with respect to the horizontal become smaller at positions corresponding to a connection portion between the crank case 12 and the cylinder body 13 as viewed from the lateral. A tip portion from the bent portion of the first downstream portion 52*g* which is the upper one of the first and second downstream portions 52*g* and 52*h* inclines forward and downward, and extends straight in a side view. A tip portion from the bent portion of the second downstream portion 52*h* positioned on the lower side inclines forward and upward, and extends straight in a side view.

The third and fourth downstream portions 52*i* and 52*j* connected to the second collecting portion 52*f* extend upward and downward, respectively, as they go to the downstream side (forward) from the second collecting portion 52*f* as shown in FIG. 2. These third and fourth downstream portions 52*i* and 52*j* are bent such that their inclination angles with respect to the horizontal become smaller than those of the upstream sides at positions corresponding to the connection portion between the crank case 12 and the cylinder body 13 as viewed from the lateral.

The inclination angles with respect to the horizontal of tip portions from the bent portions of the third and fourth downstream portions 52*i* and 52*j* are larger than the inclination angles with respect to the horizontal of the first and second downstream portions 52*g* and 52*h*. A tip portion from the bent portion of the third downstream portion 52*i* which is the upper one of the third and fourth downstream portions 52*i* and 52*j* inclines forward and upward, and extends straight in a side view. A tip portion from the bent portion of the fourth downstream portion 52*j* positioned on the lower side is inclined forward and downward, and extends straight in a side view.

As shown in FIG. 2, an outlet end portion of the third downstream portion 52*i* is positioned above an outlet end portion of the first downstream portion 52*g*. Also, an outlet end portion of the fourth downstream portion 52*j* is positioned below an outlet end portion of the second downstream portion 52*h*. As shown in FIG. 3, the outlet end portions of the first to fourth downstream portions 52*g* to 52*j* are bent toward the center in the left-right direction of the outboard motor 1.

The second exhaust pipe 53 is connected to the first exhaust pipe 52 ahead of the crank case 12, that is, on the opposite side of the cylinder head 3 with respect to the crank case 12 as shown in FIG. 3. The second exhaust pipe 53 is configured to extend to the diagonally right front of the engine 2. The second exhaust pipe 53 is formed preferably by integrally molding by casting the four tubular portions 53*a* and two flanges 53*b* and 53*c* respectively positioned on the upstream side ends and the downstream side ends of these tubular portions 53*a* as shown in FIG. 6 and FIG. 7, for example.

The third exhaust pipe 54 is arranged on the lateral right side of the engine 2, that is, at a position adjacent aside the crank case 12 as shown in FIG. 3. The third exhaust pipe 54 extends in the front-rear direction of the outboard motor 1, that is, a direction in which the crank case 12 and the cylinder body 13 are lined up. Then, the third exhaust pipe 54 connects the second exhaust pipe 53 to the exhaust chamber 55. The exhaust chamber 55 is positioned on the lateral right side of the cylinder body 13, that is, on the opposite side of the first exhaust pipe 52 in the left-right direction of the outboard motor 1. The third exhaust pipe 54 is formed preferably by integrally molding by casting the four tubular portions 54*a* and two flanges 54*b* and 54*c* respectively positioned on the upstream side ends and the downstream side ends of these tubular portions 54*a* as shown in FIG. 6 and FIG. 7, for example.

As shown in FIG. 3, these first to third exhaust pipes 52 to 54 extend from the exhaust gas outlets 29 in a plan view. Further, the first to third exhaust pipes 52 to 54 define a bypass exhaust pipe which extends along the crank case 12 in the vicinity of the outside (vicinity of the front) of the crank case 12, and bypasses the engine 4 and extends to the opposite side in the left-right direction of the outboard motor 1 (right side of the outboard motor 1). Preferably, the length of the first to third exhaust pipes 52 to 54 (the bypass exhaust pipe) is designed so as to surround the crankshaft 11 at angles not less than 90 degrees in the rotation direction of the crankshaft 11.

As shown in FIG. 3, the upstream portion of the first exhaust passage 59 defined inside the first to third exhaust pipes 52 to 54 and the intake passage on the downstream side of the intake surge tank 31 (intake passage defined inside the intake pipe 32, inside the intake hole 31*a*, and inside the intake port 22) have a substantially S shape in a plan view. The intake passage on the downstream side of the intake surge tank 31 preferably is an intake passage formed inside the intake pipe 32, the intake hole 31*a*, and the intake port 22. The first to third exhaust pipes 52 to 54 and the intake passage may have a mirror-reversed S shape in a plan view (that is, an S shape in a bottom view). This mirror-reversed S shape is also included in one mode of "S shape." In other words, the first to third exhaust pipes 52 to 54 and the intake passage extend opposite to each other in the left-right direction of the outboard motor from the cylinder head 14. Then, the intake passage curves so as to bypass the cylinder head 14 at the rear portion of the outboard motor. On the other hand, the bypass exhaust pipe defined by the first to third exhaust pipes 52 to 54 curves so as to bypass the engine 4 to the front of the crank case 12 at the front portion of the outboard motor.

Figure 8:
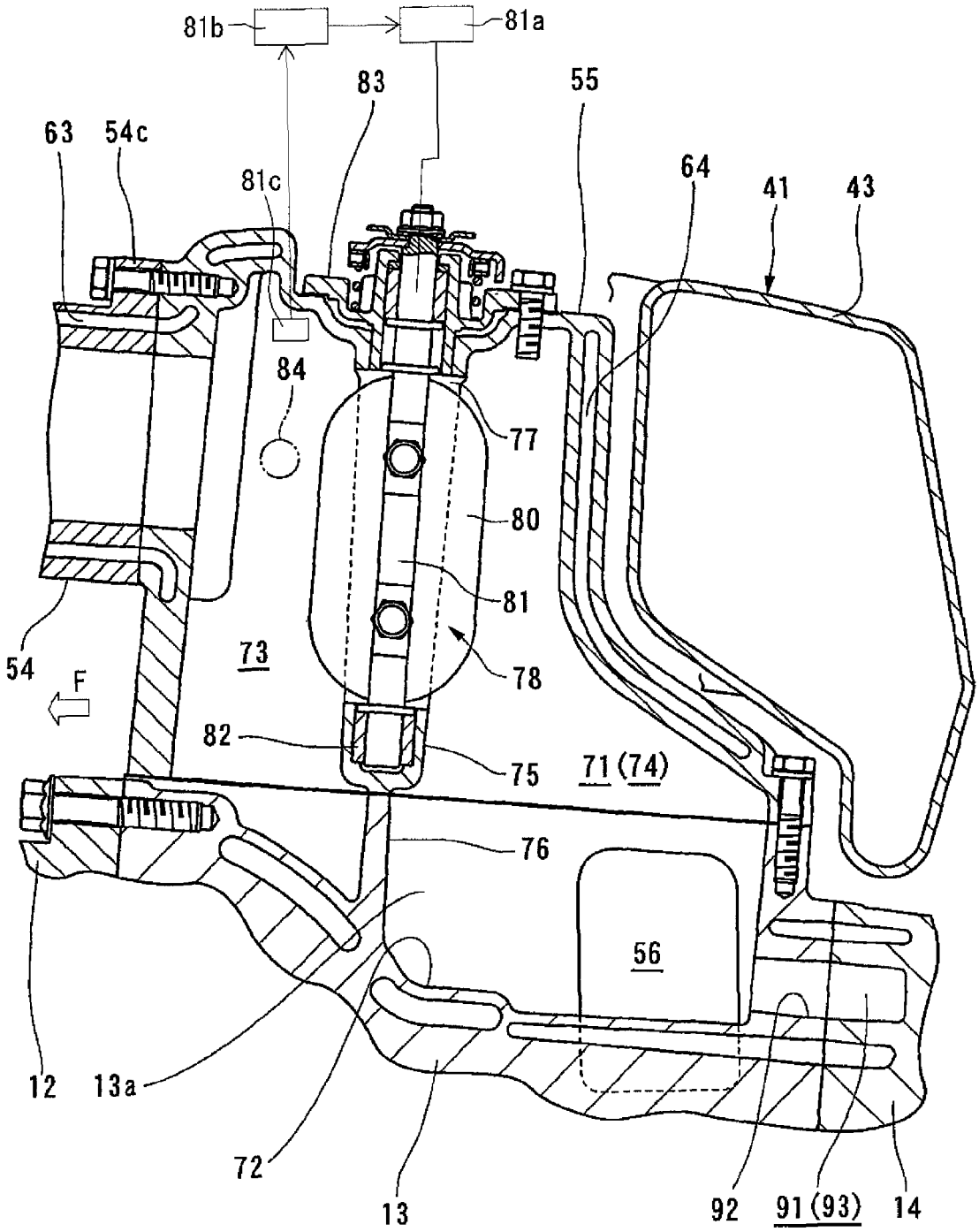
FIG. 8 is a sectional view of an exhaust chamber.

FIG. 8 is a sectional view of the exhaust chamber 55. The exhaust chamber 55 preferably has a box shape which opens to the cylinder body 13. The exhaust chamber 59 is attached to the side portion on the outboard motor right side of the cylinder body 13 such that the opening portion of the exhaust chamber is closed by the cylinder body 13. On the side portion of the cylinder body 13, a recess portion 72 which opens to the exhaust chamber 55 (to the right side of the outboard motor 1) is provided. The recess portion 72 defines an expansion chamber 71 in conjunction with the exhaust chamber 55. Accordingly, the expansion chamber 71 has a capacity larger than the inner space of the exhaust chamber 55. On the lower wall 13*a* of the cylinder body 13 which defines the side wall on the lower side of the recess portion 72, as shown in FIG. 6 and FIG. 8, the main exhaust passage 56 opens.

As shown in FIG. 5, near the lower side of the exhaust chamber 55, the upstream side horizontal portion 44 of the intake duct 41 is positioned. Also, as shown in FIG. 8, on the opposite side (near the rear side) of the third exhaust pipe 54 of the exhaust chamber 55, the downstream side vertical portion 43 of the intake duct 41 is positioned. As shown in FIG. 6, the exhaust chamber 55 preferably has a height in the up-down direction that is longer than the width in the front-rear direction to allow the four third exhaust pipes 54 to be connected thereto.

As shown in FIG. 8, inside the outer wall of the exhaust chamber 55, a coolant passage 64 is provided. The coolant passage 64 is arranged such that a coolant is supplied from the coolant passage 63 of the third exhaust pipe 54. Also, the coolant passage 64 is configured to discharge a coolant supplied from the coolant passage 63 of the third exhaust pipe 54 to a coolant discharge passage (not shown) of the cylinder body 13.

As shown in FIG. 8, inside the exhaust chamber 55, a partition 75 is arranged to partition the expansion chamber 71 into an upstream exhaust gas chamber 73 and a downstream exhaust gas chamber 74. The partition 75 partitions the expansion chamber 71 into the two chambers 73 and 74 in cooperation with a longitudinal wall 76 stood on the cylinder body 13. In the present preferred embodiment, a partition is preferably defined by a division wall 75 and a longitudinal wall 76, for example.

In the partition 75, a communicating hole 77 which makes communication between both the gas chambers 73 and 74 is provided. Further, the partition 75 is provided with an on-off valve 78 which opens and closes the communicating hole 77. The communication hole 77 is positioned at the central portion in the up-down direction of the division wall 75, that is, at a position spaced downward from the upper wall 79 (see FIG. 6 and FIG. 9) inside the exhaust chamber 55 in the first exhaust passage 59. Further, the communication hole 77 is positioned at a central portion of the division wall 75 in the left-right direction of the outboard motor 1. The opening shape of the communicating hole 77 preferably is an ellipse shape that allows the valve body 80 of the on-off valve 78 to be inserted therein.

As shown in FIG. 6, the exhaust chamber 55 is arranged at substantially the same height as the engine 4. The exhaust chamber 55 is provided at the highest position in the first exhaust passage 59. In other words, in the present preferred embodiment, the highest portion of the first exhaust passage 59 is inside the exhaust chamber 55. The highest portion of the first exhaust passage 59 has an upstream side exhaust gas chamber 73 and a downstream side exhaust gas chamber 74 partitioned by the division wall 75 and the longitudinal wall 76, and a communication hole 77 which causes the upstream side exhaust gas chamber 73 to communicate with the downstream side exhaust gas chamber 74.

On the other hand, as shown in FIG. 8, the on-off valve 78 preferably is a butterfly valve having a disk-shaped valve body 80 inserted inside the communicating hole 77. The valve body 80 preferably includes an elongated oval plate in the left-right direction of the partition 75. The valve body 89 is attached to a valve shaft 81 extending along the partition 75. The valve shaft 81 is pivotally supported by a bearing 82 and a cover 83 fixed to the partition 75. In addition, the valve shaft 81 is connected to a drive device 81*a* via a wire. The valve body 89 and the valve shaft 81 rotate according to driving of the drive device 81*a*. The drive device 81*a* is controlled by an ECU (Electronic Control Unit) 81*b*. For example, the ECU 81*b* controls the drive device 81*a* based on a detection value of the pressure sensor 81*c*. In the present preferred embodiment, the ECU 81*b* functions as a control device.

The on-off valve 78 is driven by the drive device 81*a* so as to close when the crankshaft 11 rotates in reverse or the pressure inside the first exhaust passage 59 excessively decreases and a high negative pressure is generated inside the exhaust chamber 55, and to open at other times. A sensor (not shown) for detecting the rotating speed of the crankshaft 11 detects whether the crankshaft 11 has rotated in reverse. Also, the pressure inside the exhaust chamber 55 is detected by a pressure sensor 81*c*. For example, when a high negative pressure is generated inside the exhaust chamber 55, the ECU 81*b* controls the drive device 81*a* to close the on-off valve 78. Accordingly, the communication hole 77 is closed and a fluid is prevented from flowing between the upstream side exhaust gas chamber 73 and the downstream side exhaust gas chamber 74.

As shown in FIG. 6, at the upper end of the exhaust chamber 55, an oxygen sensor 84 is provided to detect the amount of oxygen in the exhaust gas. In the present preferred embodiment, the oxygen sensor 84 functions as an exhaust gas concentration sensor. The oxygen sensor 84 detects, for example, an amount of oxygen in the exhaust gas from a voltage generated by a difference between an oxygen partial pressure of exhaust gas and an oxygen partial pressure of the atmosphere. The oxygen sensor 84 preferably is a sensor primarily made of ceramic (for example, zirconia). The oxygen sensor 84 may detect an oxygen concentration in exhaust gas as an electric resistance. In this sensor, for example, cerium oxide ($CeO_2$) is preferably used as ceramic. The oxygen sensor 84 is positioned at an upper end portion of the upstream exhaust gas chamber 73. The oxygen sensor 84 detects an amount of oxygen in the exhaust gas flowing inside the upstream exhaust gas chamber 73. The oxygen sensor 84 sends the detected amount of oxygen as detection data to an ECU 81*b* (see FIG. 8) of the engine 2. The ECU 81*b* controls the fuel injection amount of the injector 27 and the ignition timing of the ignition plug (not shown), etc., based on the rotation speed of the engine 2, the opening degree of the throttle valve 46, and the amount of oxygen in the exhaust gas detected by the oxygen sensor 84, etc.

Next, a second exhaust passage 91 will be described. As shown in FIG. 6, the exhaust device 51 further includes a second exhaust passage 91 which exhausts exhaust gas inside the first exhaust passage 59 into the atmosphere. The second exhaust passage 91 is a passage arranged to expel exhaust gas to the outside of the outboard motor 1 when the speed of the engine 4 is low as in the case during idling. In other words, during idling of the engine 4, the pressure of exhaust gas to be exhausted from the engine 4 is relatively low. Therefore, when idling the engine 4, water (indicated by a reference symbol W in FIG. 6 and FIG. 11) which has entered the inside of the first exhaust passage 59 from an outlet of the first exhaust passage 59 (outlet of the main exhaust passage 56) cannot be discharged by the pressure of the exhaust gas. Therefore, in this case, the exhaust gas is exhausted exclusively through the second exhaust passage 91.

As shown in FIG. 6, an inlet end portion of the second exhaust passage 91 is connected to the highest portion of the exhaust chamber 55. The second exhaust passage 91 includes a passage inlet 92, a first vertical portion 93, and a sound absorbing chamber 95. The first vertical portion 93 extends from the passage inlet 92 to a lower end portion of the engine 4 along the exhaust chamber 55. In addition, the sound absorbing chamber 95 communicates with a lower end of the first vertical portion 93 via a first connecting passage 94 formed in the engine support member 3. The sound absorbing chamber 95 is arranged at the downstream side end portion of the second exhaust passage 91. The sound absorbing chamber 95 is connected to a muffler 97 via a communication path 96. The communication path 96 is a path which causes the inside of the sound absorbing chamber 95 and the inside of the muffler 67 to communicate.

Figure 9:
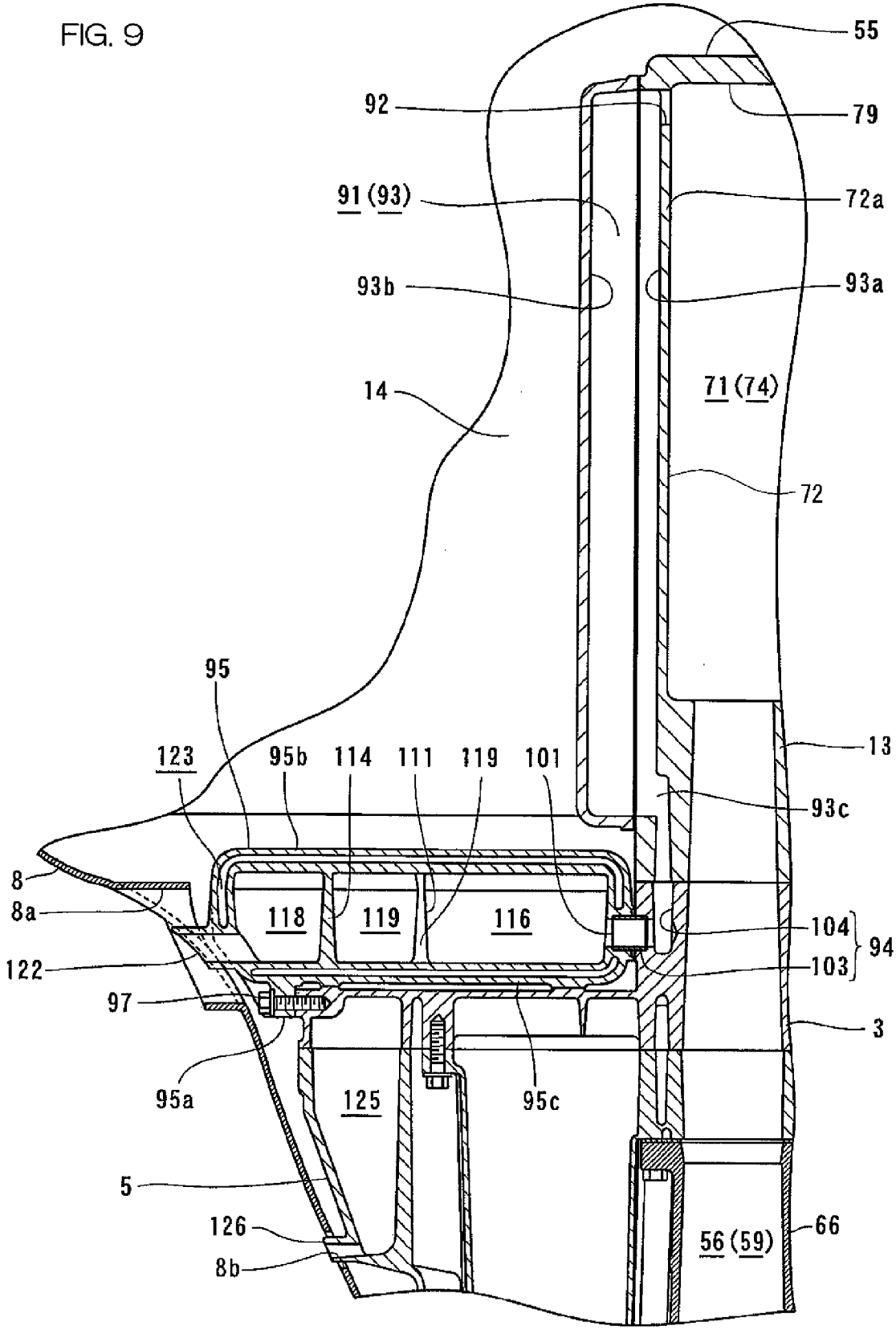
FIG. 9 is an enlarged longitudinal sectional view of a portion of a second exhaust passage, along the IX-IX line of FIG. 10.
Figure 10:
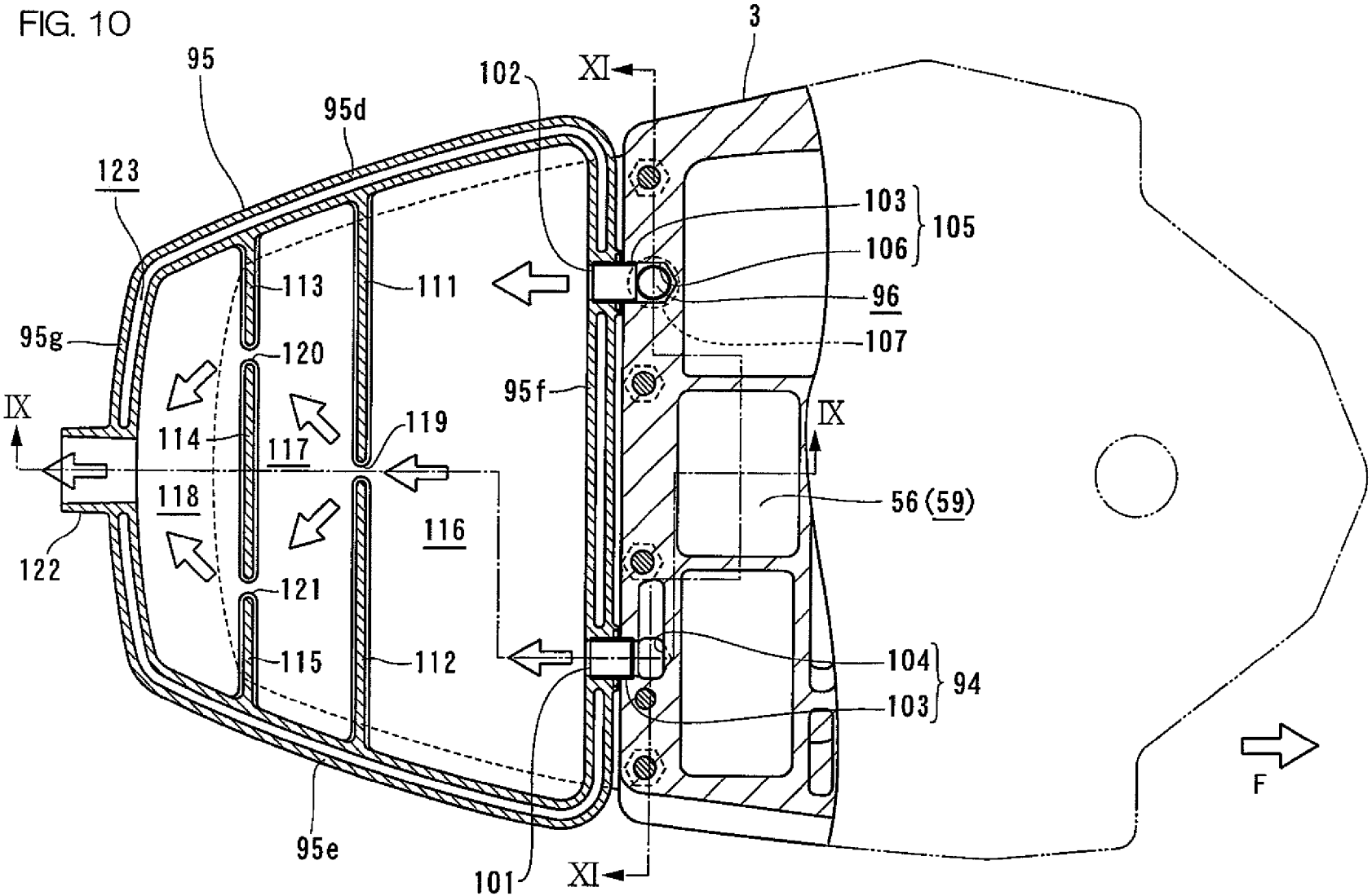
FIG. 10 is an enlarged transverse sectional view of a portion of the second exhaust passage.

FIG. 9 is an enlarged longitudinal sectional view of a portion of the second exhaust passage 91, along the IX-IX line of FIG. 10. The passage inlet 92 is defined by a through hole penetrating through a wall 72*a* on the outboard motor rear side of a recessed portion 72 provided on the cylinder body 13. The passage inlet 92 is formed at the highest position of the wall 72*a*. In other words, the inlet end portion of the second exhaust passage 91 is connected to the highest portion which is on the downstream side of the first and second catalysts 57 and 58 and the oxygen sensor 84 in the first exhaust passage 59.

The first vertical portion 93 includes a first recessed groove 93*a*, a second recessed groove 93*b*, and a passage hole 93*c*. The first recessed groove 93*a* is arranged on the cylinder body 13 so as to open toward the cylinder head 14. Also, the second recessed groove 93*b* is arranged on the cylinder head 14 so as to be opposed to the first recessed groove 93*a*. The passage hole 93*c* is formed at a lower end portion of the cylinder body 13 so as to be connected to lower end portions of the recessed grooves 93*a* and 93*b*.

FIG. 10 is an enlarged transverse sectional view of a portion of the second exhaust passage 91. The sound absorbing chamber 95 includes a plurality of partitioning plates 111 to 115, a plurality of expansion chambers (first to third expansion chambers 116 to 118), and a plurality of communication holes (first to third communication holes 119 to 121). The inside of the sound absorbing chamber 95 is partitioned by the plurality of partitioning plates 111 to 115 into the first to third expansion chambers 116 to 118. In addition, the first to third expansion chambers 116 to 118 are made to communicate with each other by the first to third communication holes 119 to 121. In the present preferred embodiment, the first to third communication holes 119 to 121 define expansion chamber communication holes.

The sound absorbing chamber 95 is formed preferably by casting so as to have a hollow box shape as shown in FIG. 9 and FIG. 10. The sound absorbing chamber 95 is placed on a rear end portion of the engine support member 3. As shown in FIG. 9, the sound absorbing chamber 95 is fixed to the engine support member 3 by an attaching bolt 97. The attaching bolt 97 is threaded to the engine support member 3 while penetrating through an attaching bracket 95*a* of the sound absorbing chamber 95 from the rearward of the sound absorbing chamber 95.

As shown in FIG. 10, to both sides in the left-right direction of the outboard motor 1 at a front end portion of the sound absorbing chamber 95, first and second connecting pipes 101 and 102 arranged to connect the front end portion of the sound absorbing chamber 95 to the engine support member 3 are attached. These connecting pipes 101 and 102 are attached to the sound absorbing chamber 95 such that their center lines extend along the front-rear direction of the outboard motor 1. The first connecting pipe 101 is arranged on the outboard motor right side, and the second connecting pipe 102 is arranged on the outboard motor left side. The first and second connecting pipes 101 and 102 project forward from the front end surface of the sound absorbing chamber 95.

The projecting portions of the connecting pipes 101 and 102 are removably fitted into two circular holes 103 formed in the engine support member 3. The sound absorbing chamber 95 is removed from the engine support member 3 by being pulled rearward in a state in which the attaching bolt 97 is removed from the attaching bracket 95*a*. By fitting the projecting portions of the two connecting pipes 101 and 102 into the two circular holes 103 from the rearward, the sound absorbing chamber 95 is attached to the engine support member 3 from the rearward.

As shown in FIG. 9, the first connecting pipe 101 causes the inside of the sound absorbing chamber 95 to communicate with a first connecting passage 94 formed in the engine support member 3. The first connecting passage 94 includes a circular hole 103 into which the first connecting pipe 101 is fitted and a passage hole 104 extending upward to the passage hole 93*c* of the cylinder body 13 from the front end of the circular hole 103.

As shown in FIG. 10, the second connecting pipe 102 causes the inside of the sound absorbing chamber 95 to communicate with a second connecting passage 105 formed in the engine support member 3. The second connecting passage 105 constitutes a portion of the communication path 96. The second connecting passage 105 includes a circular hole 103 into which the second connecting pipe 102 is fitted and a passage hole 106 extending downward from the front end of the circular hole 103.

Inside the sound absorbing chamber 95, as shown in FIG. 9 and FIG. 10, first to third expansion chambers 116 to 118 partitioned by the plurality of partitioning plates 111 to 115 are provided. The first to third expansion chambers 116 to 118 are arranged in the front-rear direction of the outboard motor 1 in this order from the outboard motor forward side.

Between the first expansion chamber 116 and the second expansion chamber 117, a partition plate 111 and a partition plate 112 are arranged. Between the partition plate 111 and the partition plate 112, a first communication hole 119 arranged to lead exhaust gas from the first expansion chamber 116 to the second expansion chamber 117 is provided. Also, between the second expansion chamber 117 and the third expansion chamber 118, the partition plate 113, the partition plate 114, and the partition plate 115 are arranged. Between the partition plate 113 and the partition plate 114, a second communication hole 120 arranged to lead exhaust gas from the second expansion chamber 117 to the third expansion chamber 118 is provided. Also, between the partition plate 114 and the partition plate 115, a third communication hole 121 arranged to lead exhaust gas from the second expansion chamber 117 to the third expansion chamber 118 is provided.

The first to third communication holes 119 to 121 preferably are formed like slits, respectively, for example. The opening areas of the first to third communication holes 119 to 121 are smaller than a passage cross-section area of a narrowest portion of the passage on the upstream side of the sound absorbing chamber 95 (the smallest passage cross-section area on the upstream side of the sound absorbing chamber 95). In other words, a resistance when exhaust gas passes through the sound absorbing chamber 95 is higher than a resistance when exhaust gas flows in the two passages on the upstream side of the sound absorbing chamber 95. Accordingly, a concentrated flow of exhaust gas into one passage with a smaller resistance when exhaust gas flows of the two passages can be prevented. In other words, a concentrated flow of exhaust gas into one passage with a smaller resistance when exhaust gas flows of a passage from the exhaust chamber 55 to the sound absorbing chamber 95 and a passage from the muffler 67 to the sound absorbing chamber 95 (corresponding to the communication passage 96) can be prevented.

As shown in FIG. 9 and FIG. 10, on a rear end portion of the sound absorbing chamber 95, at the central portion in the width direction of the outboard motor 1, an exhaust pipe 122 is provided. A projecting side end portion of the exhaust pipe 122 is inserted into an idling exhaust port 8*a* located at the rear end portion of the engine cover 8 as shown in FIG. 9. The third expansion chamber 118 of the sound absorbing chamber 95 communicates with the outside of the sound absorbing chamber 95 via the exhaust pipe 122. Therefore, exhaust gas which entered into the sound absorbing chamber 95 through the first and second connecting pipes 101 and 102 passes through the first to third expansion chambers 116 to 118 and is exhausted to the rearward of the engine cover 8 from the exhaust pipe 122. Also, when exhaust gas which entered into the sound absorbing chamber 95 passes through the first to third expansion chambers 116 to 118, noise of the exhaust gas is absorbed.

As shown in FIG. 9 and FIG. 10, inside the outer wall (an upper wall 95*b*, a lower wall 95*c*, a left side wall 95*d*, a right side wall 95*e*, a front wall 95*f*, and a rear wall 95*g*) of the sound absorbing chamber 95, a coolant passage 123 is defined. Into the coolant passage 123, a portion of coolant which cooled the engine 1 is supplied by a coolant hose 124 (see FIG. 12). The coolant hose 124 is connected to an end portion on the outboard motor rear side at an upper end portion of the sound absorbing chamber 95.

Figure 11:
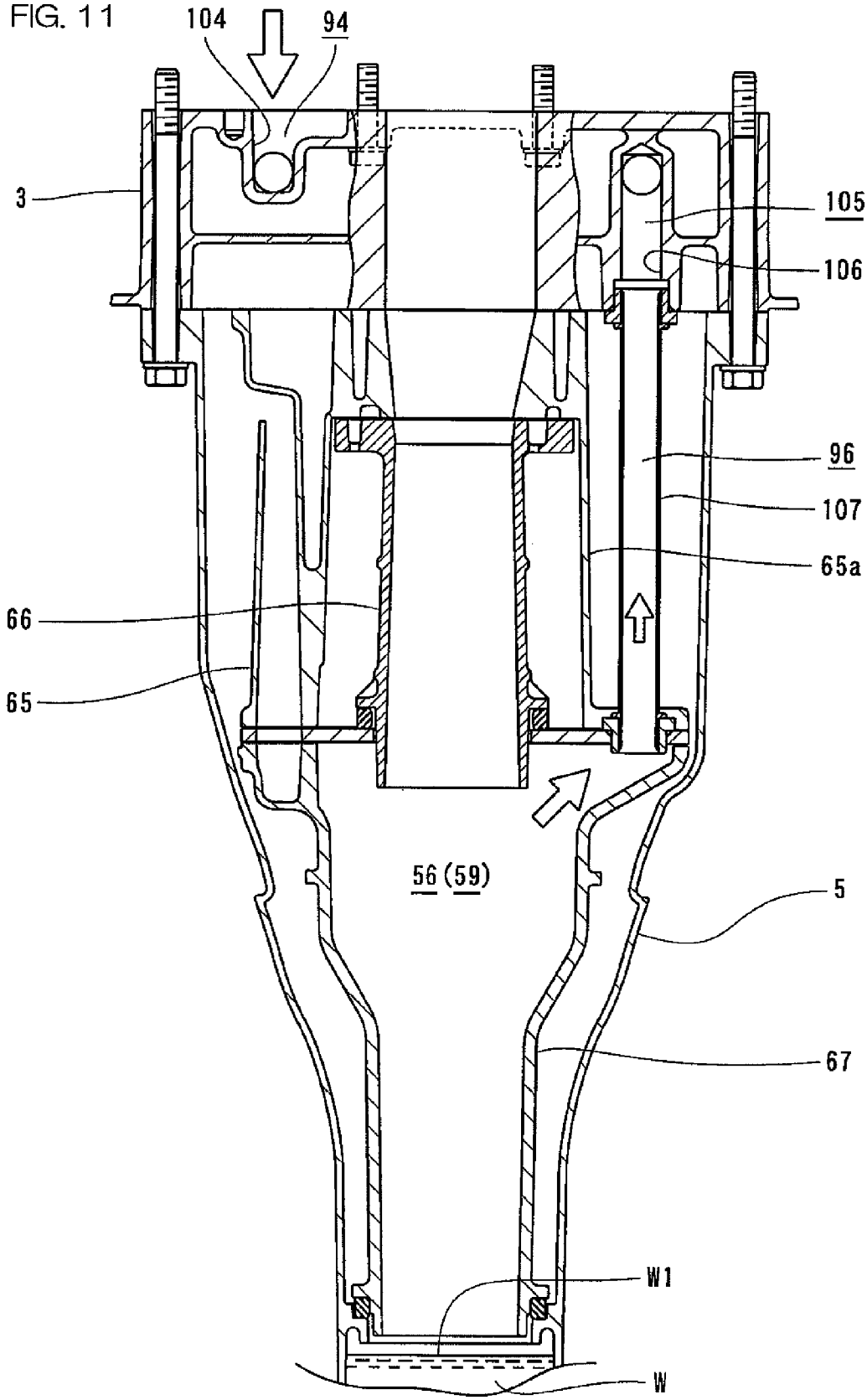
FIG. 11 is an enlarged longitudinal sectional view of a downstream side end portion of the first exhaust passage and a communication path, along the XI-XI line of FIG. 10.

FIG. 11 is an enlarged longitudinal sectional view of the downstream side end portion of the first exhaust passage 59 and the communication path 96, along the XI-XI line of FIG. 10. The communication path 96 includes the second connecting pipe 102 (see FIG. 10), a second connecting passage 105, and a communicating pipe 107. The second connecting passage 105 includes a passage hole 106 extending along the up-down direction. The passage hole 106 opens in the lower surface of the engine support member 3. A lower end of the passage hole 106 is connected to the muffler 67 positioned below the passage hole 106 by a communicating pipe 107. Accordingly, the inside of the muffler 67 is made to communicate with the inside of the sound absorbing chamber 95 via the communication path 96. The communicating pipe 107 is positioned between a side wall 65*a* of an oil pan 65 and the upper casing 5, and extends along the up-down direction. The communicating pipe 107 is sandwiched by the lower end portion of the engine support member 3 and an upper end portion of the muffler 67.

Water enters a portion lower than the muffler 67 in the first exhaust passage 59 from the propeller 7 side in an operation state in which the pressure of the exhaust gas decreases as in the case during idling. The water surface W1 of water W which entered the inside of the first exhaust passage 59 reaches a portion near the lower side of the muffler 67. Therefore, the communication path 96 communicates a portion which is higher than the water surface W1 in the first exhaust passage 59 and near the water surface W1 and the second exhaust passage 91 with each other.

Figure 12:
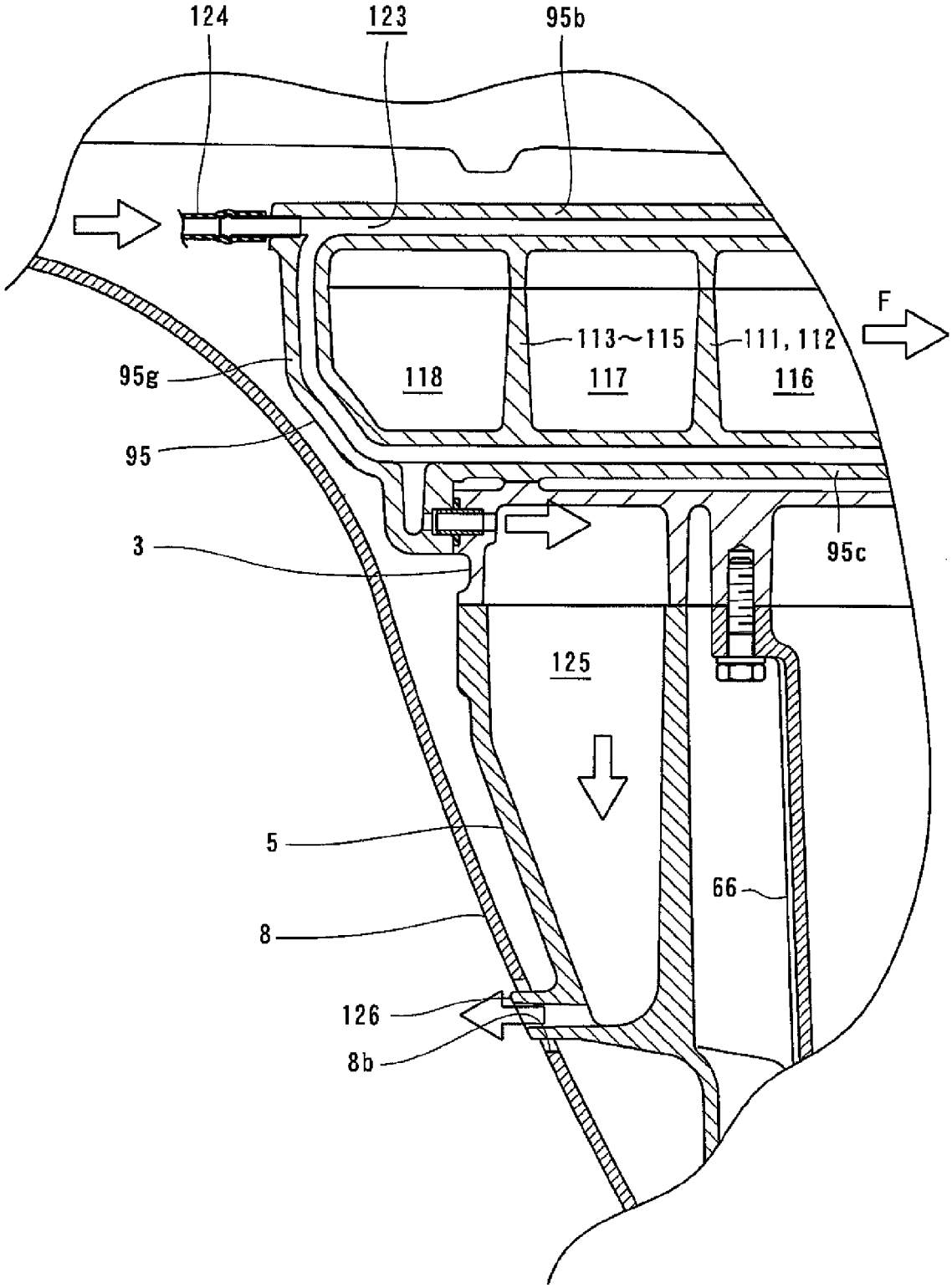
FIG. 12 is an enlarged sectional view of a rear end portion of a sound absorbing chamber and a coolant chamber.

FIG. 12 is an enlarged sectional view of the rear end portion of the sound absorbing chamber 95 and a coolant chamber 125. The coolant passage 123 formed in the sound absorbing chamber 95 is connected to the coolant chamber 125 at the lower end portion of the sound absorbing chamber 95. The coolant chamber 125 is defined by two recesses respectively formed on the rear end portion of the engine support member 3 and the rear end portion of the upper casing 5. In other words, the rear end portion of the engine support member 3 and the rear end portion of the upper casing 5 are overlapped with each other in the up-down direction. In addition, a recess recessed upward is formed on the portion overlapped with the upper casing 5 at the rear end portion of the engine support member 3. A recess recessed downward is formed at the portion overlapped with the engine support member 3 at the rear end portion of the upper casing 5. The spaces inside these two recesses communicate with each other. Accordingly, the coolant chamber 125 is formed. At the lower end portion of the coolant chamber 125, a pipe 126 arranged to make a coolant as pilot water flow out rearward of the outboard motor 1 is provided. In other words, the coolant passage 123 provided in the sound absorbing chamber 95 is provided at an intermediate portion of the passage which leads pilot water from the engine 1 to the pipe 126.

The pipe 126 is inserted in a through hole 8*b* opened in the rear surface of the engine cover 8. The pipe 126 projects to the outside of the engine cover 8. As shown in FIG. 9, the pipe 126 is arranged near the lower side of the exhaust pipe 122.

Portions in which the exhaust pipe 122 and the pilot water pipe 126 are exposed of the rear surface of the engine cover 8 are exposed to exhaust gas exhausted from the exhaust pipe 122 and stained with, for example, carbon. In addition, the exposed portions are stained with seawater flowing out from the pilot water pipe 126 and whitened by salt. In the present preferred embodiment, the exhaust pipe 122 and the pilot water pipe 126 are provided close to each other, such that the area to be stained on the engine cover 8 is small. Therefore, it becomes difficult for the external appearance of the outboard motor 1 to be deteriorated, and it is easily cleaned.

Technical effects and advantages of the outboard motor 1 of the present preferred embodiment will be illustrated hereinafter.

When a hull including the outboard motor 1 runs, most of the exhaust gas of the engine 4 is exhausted into water from an axis portion of the propeller 7 through the first to third exhaust pipes 52 to 54, the exhaust chamber 55, and the main exhaust passage 56. In other words, most of exhaust gas of the engine 4 is exhausted into water from the axis portion of the propeller 7 through the first exhaust passage 59. In addition, a portion of the exhaust gas which entered the first exhaust passage 59 is exhausted rearward of the engine cover 8 through the second exhaust passage 91. Also, in an operation state in which the speed of the engine 4 is relatively low as in the case during idling, the pressure of the exhaust gas to be exhausted from the engine 4 is relatively low. Therefore, in this operation state, the outlet of the first exhaust passage 59 is closed by water, and the exhaust gas which entered the first exhaust passage 59 is exhausted to the outside of the outboard motor 1 exclusively through the second exhaust passage 91.

At the lower end portion of the first exhaust passage 59, water comes into contact with the exhaust gas and the wall (the upper casing 5 and the muffler 6, etc.,) of the first exhaust passage 59 heated by the exhaust gas at a high temperature, such that water vapor is produced. Water vapor produced inside the first exhaust passage 59 ascends toward the highest portion of the first exhaust passage 59 when the amount of exhaust gas to be exhausted into the first exhaust passage 59 from the engine 4 is relatively small as in the case during idling. Therefore, water vapor at the lower end portion of the first exhaust passage 59 ascends toward the downstream side exhaust gas chamber 74 of the exhaust chamber 55. In other words, when the amount of exhaust gas to be exhausted into the first exhaust passage 59 from the engine 4 is relatively small, water vapor stagnates in a range from the lower end portion to the upper end portion of the first exhaust passage 59.

In the present preferred embodiment, when the engine 4 is operated at a low engine speed as in the case during idling, water vapor at the lower end portion of the first exhaust passage 59 is pushed out into the communication path 96 by the exhaust gas. Therefore, water vapor at the lower end portion of the first exhaust passage 59 is discharged to the outside of the outboard motor 1 through the communication path 96 and the second exhaust passage 91. Also, water vapor at the upper end portion of the first exhaust passage 59 is pushed out into the passage inlet 92 of the second exhaust passage 91 from the inside of the exhaust chamber 55 by the exhaust gas. Therefore, water vapor at the upper end portion of the first exhaust passage 59 is discharged to the outside of the outboard motor 1 through the second exhaust passage 91. Accordingly, the amount of water vapor to flow into the first and second catalysts 57 and 58 and the vicinity of the oxygen sensor 84 is reduced.

Also, during operation of the engine at a high engine speed, when the throttle valve 46 is rapidly returned to a fully closed state from a fully opened state, the engine 4 misfires, and the pressure inside the first exhaust passage 59 may decrease excessively. In this case, the atmosphere is suctioned into the first exhaust passage 59 through the second exhaust passage 91 from the outside of the outboard motor 1. Therefore, the pressure inside the first exhaust passage 59 can be prevented from becoming excessively negative. Therefore, even if water vapor stagnates inside the first exhaust passage 59, the water vapor can be prevented from being liquefied by decreasing of the pressure.

Thus, according to the present preferred embodiment, water vapor produced inside the first exhaust passage 59 is discharged to the outside of the outboard motor 1 through the second exhaust passage 91. In addition, the pressure inside the first exhaust passage 59 can be prevented from excessively decreasing by suctioning the outside air from the second exhaust passage 91. As a result, production of water inside the first exhaust passage 59 due to liquefaction of water vapor inside the first exhaust passage 59 can be prevented. Therefore, it is difficult for water to attach to the first and second catalysts 57 and 58 and the oxygen sensor 84. Therefore, these members can be prevented from being damaged by attachment of water. Therefore, an exhaust device 51 in which it is difficult for water to attach to the first and second catalysts 57 and 58 and the oxygen sensor 84 and these members can be prevented from being damaged by attachment of water, can be provided.

In addition, the highest portion of the first exhaust passage 59 is formed by the upstream side exhaust gas chamber 73 and the downstream side exhaust gas chamber 74 partitioned by the division wall 75 and the longitudinal wall 76 and the communication hole 77 which causes the upstream side exhaust gas chamber 73 to communicate with the downstream side exhaust gas chamber 74. Also, the oxygen sensor 84 is provided in the upstream side exhaust gas chamber 73, and the inlet end portion of the second exhaust passage 91 is connected to the downstream side exhaust gas chamber 74. Therefore, even in a state in which the on-off valve 78 in the communication hole 77 is open, the division wall 75 and the longitudinal wall 76 substantially function as a dam, and the amount of water vapor to flow to the oxygen sensor 84 side of the division wall 75 and the longitudinal wall 76 is reduced. As a result, the catalysts 57 and 58 and the oxygen sensor 84 are more reliably prevented from being damaged.

By closing the on-off valve 78, the flow of water from the upstream side exhaust gas chamber 73 to the downstream side exhaust gas chamber 74 can be blocked. Therefore, even if water stagnating at the lower end portion of the first exhaust passage 59 is suctioned by the negative pressure and ascends, this water can be prevented from flowing backward to the upstream side of the on-off valve 78.

The phenomenon in which water ascends inside the first exhaust passage 59 occurs infrequently when the shift position is switched to "reverse" by the forward-reverse switching mechanism 18 during advancing of the hull in order to brake the hull, for example. In other words, when the forward-reverse switching mechanism 18 is switched to the reverse side during advancing of the hull, in a case in which the speed of the hull is high, the propeller 7 is pushed by a strong force of water and cannot rotate in reverse. Instead the drive shaft 17 (engine 2) may be rotated in reverse.

When the engine 4 is thus rotated in reverse, the piston moves down while the exhaust valve 25 opens, and exhaust gas in the first exhaust passage 59 is suctioned into the cylinders 21. In addition, the longer the time during which the engine 2 rotates in reverse, the larger the amount of exhaust gas to be suctioned into the engine 4. However, if the amount of exhaust gas to be suctioned into the engine 4 increases, the negative pressure inside the first exhaust passage 59 becomes higher, and water ascends inside the first exhaust passage 59.

When the hull including the outboard motor 1 is used at sea, seawater enters the inside of the first exhaust passage 59. When the seawater comes into contact with the catalysts 57 and 58, the catalysts 57 and 58 are poisoned and deteriorated by Na, Mg, and Cl, etc., of seawater components. When the catalysts 57 and 58 at a high temperature are splashed with water, sudden shrinkage may cause the catalysts 57 and 58 to crack. Further, when water goes upstream in the first exhaust passage 59 and is suctioned into the engine 4, a so-called water hammer phenomenon occurs and may damage the engine 4.

In the present preferred embodiment, when water ascends inside the first exhaust passage (when the engine 4 rotates in reverse or the pressure inside the exhaust chamber 55 becomes excessively low), the on-off valve 78 in the exhaust chamber 55 is closed. Accordingly, water going upstream can be stopped by the exhaust chamber 55. Therefore, suctioning of water into the engine 4 through the first to third exhaust pipes 52 to 54 can be reliably prevented. Therefore, the catalysts 57 and 58 can be reliably prevented from being deteriorated by contact with seawater. Further, the catalysts 57 and 58 at a high temperature can be reliably prevented from being suddenly cooled by water and damaged. In addition, an occurrence of a water hammer phenomenon can also be prevented.

Water vapor inside the first exhaust passage 59 is produced most near the water surface W1. The second exhaust passage 91 communicates with the portion near the upper side of the water surface W1 inside the first exhaust passage 59 via the communication path 96. Therefore, water vapor inside the first exhaust passage 59 is exhausted to the outside of the outboard motor 1 from the lower portion of the first exhaust passage 59 near the source of water vapor in addition to the highest portion of the first exhaust passage 59. Accordingly, the amount of water vapor inside the first exhaust passage 59 can be reliably reduced.

It is known that carbon adheres to the wall of the first exhaust passage 59, and when water vapor comes into contact with sulfur contained in the carbon, sulfuric acid is produced. When sulfuric acid is produced on the wall surface of the first exhaust passage 59, a member forming the wall surface of the first exhaust passage 59 corrodes. According to the present preferred embodiment, the amount of water vapor inside the first exhaust passage 59 is greatly reduced, such that the corrosion of the wall surface of the first exhaust passage 59 can be minimized as much as possible.

Exhaust gas during idling passes through the second exhaust passage 91, and is exhausted to the outside of the outboard motor 1 from the sound absorbing chamber 95. Into the sound absorbing chamber 95, exhaust gas is introduced from both the highest portion and the lower portion of the first exhaust passage 59, such that the amount of exhaust gas to flow into the sound absorbing chamber 95 is larger than that into other portions. Therefore, the sound absorbing chamber 95 more easily corrodes than other portions.

In the present preferred embodiment, the sound absorbing chamber 95 is preferably separate from other members forming the first exhaust passage 59. Therefore, the sound absorbing chamber 95 can be made of an exclusive material. Further, exclusive surface treatment can be applied to the sound absorbing chamber 95. Specifically, the sound absorbing chamber 95 can be made of a material with high corrosion resistance. Further, surface treatment for improving corrosion resistance can be applied to the wall surfaces of the first to third expansion chambers 116 to 118. Accordingly, the corrosion resistance of the sound absorbing chamber 95 can be improved. Also, the sound absorbing chamber 95 is removably attached to the engine support member 3, such that when the sound absorbing chamber 95 greatly corrodes, the sound absorbing chamber 95 can be replaced with a new one. Therefore, the life of the entirety of the outboard motor 1 can be improved.

In addition, the opening areas of the first to third communication holes 119 to 120 provided in the sound absorbing chamber 95 are smaller than the passage cross-section area of the narrowest portion of the passage on the upstream side of the sound absorbing chamber 95. Therefore, a concentrated flow of the exhaust gas into one of the two passages connected to the sound absorbing chamber 95 (a passage from the exhaust chamber 55 to the sound absorbing chamber 95 and a communication passage 96 from the muffler 67 to the sound absorbing chamber 95) can be prevented. Therefore, an amount of sulfuric acid produced in the one passage can be prevented from being increased by the concentrated flow of the exhaust gas. Thus, the advance of corrosion in the one passage can be prevented by the concentrated flow of the exhaust gas. Accordingly, the advance of corrosion can be made slower than in the configuration in which exhaust gas flows into one of the two passages in a concentrated manner.

As described above, the exhaust device 51 can prevent the first and second catalysts 57 and 58 and the oxygen sensor 84 from being damaged by attachment of water. Therefore, the outboard motor 1 including the exhaust device 51 can sufficiently purify exhaust gas by the first and second catalysts 57 and 58, and can exhaust clean exhaust gas for a long period of time.

A detailed description was provided of the preferred embodiments of the present invention. However, the preferred embodiments are only specific examples to describe the technical content of the present invention, and the present invention is not to be construed as limited to these specific examples. The spirit and scope of the present invention is restricted only by the appended claims.

The present application corresponds to Japanese Patent Application No. 2008-221506 filed in the Japan Patent Office on Aug. 29, 2008, and the entire disclosure of the application is incorporated in its entirety herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

an engine arranged to support a crankshaft extending along an up-down direction;

a first exhaust passage which is connected to the engine and is arranged to expel exhaust gas of the engine into water;

a partition arranged to partition an inside of the first exhaust passage into an upstream side and a downstream side;

a communication portion arranged to cause the upstream side to communicate with the downstream side of the partition in the first exhaust passage;

an exhaust gas concentration sensor arranged on the upstream side of the partition in the first exhaust passage; and a catalyst arranged on an upstream side of the exhaust gas concentration sensor in the first exhaust passage; wherein the partition includes a wall that extends from a first inner wall surface of the first exhaust passage across the inside of the first exhaust passage to a second inner wall surface of the first exhaust passage that is opposed to the first inner wall surface so as to minimize an amount of water or water vapor flowing from the downstream side to the upstream side of the first exhaust passage.

2. The outboard motor according to claim 1, further comprising a second exhaust passage which includes an inlet end connected to a portion on the downstream side of the partition in the first exhaust passage, and is arranged to expel exhaust gas inside the first exhaust passage to an atmosphere.

3. The outboard motor according to claim 2, wherein the first exhaust passage includes an exhaust chamber, an inside of the exhaust chamber being partitioned by the partition into an upstream side exhaust gas chamber and a downstream exhaust gas chamber;

the exhaust gas concentration sensor is arranged in the upstream side exhaust gas chamber; and the inlet end of the second exhaust passage is connected to the downstream exhaust gas chamber.

4. The outboard motor according to claim 3, wherein the first exhaust passage includes an exhaust pipe arranged in the upstream side exhaust chamber; and the catalyst is arranged in the exhaust pipe.

5. The outboard motor according to claim 1, wherein the communication portion includes a communication hole provided in the partition and arranged to communicate between both the upstream side and the downstream side of the partition, and an on-off valve provided in the communication hole.

6. The outboard motor according to claim 5, further comprising:

a drive mechanism arranged to drive the on-off valve;

a pressure sensor arranged to detect a pressure inside the first exhaust passage;

a control device arranged to accept a detection value of the pressure sensor and to control the drive mechanism to close the on-off valve when a pressure inside the first exhaust passage is not more than a predetermined value.

7. The outboard motor according to claim 2, wherein the first exhaust passage includes a downstream side end portion in communication with water from an outside of the outboard motor during idling of the engine; and a communication path is arranged to communicate a portion higher than a water surface at a time of the idling at the downstream side end portion of the first exhaust passage and the second exhaust passage with each other.

8. The outboard motor according to claim 7, wherein the second exhaust passage includes a sound absorbing chamber which is arranged at a downstream side end portion of the second exhaust passage and is removable from the outboard motor; and an inside of the sound absorbing chamber is arranged to communicate with the first exhaust passage via the communication path.

9. The outboard motor according to claim 7, wherein the second exhaust passage includes a sound absorbing chamber which has a plurality of expansion chambers partitioned by partitioning members having expansion chamber communication holes arranged to communicate the plurality of expansion chambers with each other, and is arranged at a downstream side end portion of the second exhaust passage;

an inside of the sound absorbing chamber is arranged to communicate with the first exhaust passage via the communication path; and opening areas of the expansion chamber communication holes are smaller than a smallest passage cross-section area of a upstream side of the sound absorbing chamber.

10. The outboard motor according to claim 2, wherein the inlet end of the second exhaust passage is connected to a highest portion in the first exhaust passage.

11. The outboard motor according to claim 7, wherein the inlet end of the second exhaust passage is connected to a highest portion in the first exhaust passage.

12. The outboard motor according to claim 3, wherein the inlet end of the second exhaust passage is connected to a highest portion in the first exhaust passage; and the highest portion in the first exhaust passage is defined by the exhaust chamber.

13. The outboard motor according to claim 7, wherein the first exhaust passage includes an exhaust chamber, an inside of the exhaust chamber being partitioned by the partition into an upstream side exhaust gas chamber and a downstream side exhaust gas chamber;

the inlet end of the second exhaust passage is connected to a highest portion in the first exhaust passage; and the highest portion in the first exhaust passage is defined by the exhaust chamber.

* * * * *